US009255373B1

(12) United States Patent
Steiber et al.

(10) Patent No.: US 9,255,373 B1
(45) Date of Patent: Feb. 9, 2016

(54) SYSTEMS AND METHODS FOR REMOVAL OF TRUNNION PIN SLEEVE AND FOR SUPPORTING TAINTER GATE DURING SAID REMOVAL

(75) Inventors: Jeffrey D. Steiber, Blue River, WI (US); Steven D. Becker, Buffalo City, WI (US); Rodger W. Bean, Onalaska, WI (US); Daniel C. Wibralski, Sparta, WI (US); Michael A. McCullick, Stoddard, WI (US)

(73) Assignee: J.F. Brennan Company, Inc., La Crosse, WI (US)

( * ) Notice: Subject to any disclaimer, the term of this patent is extended or adjusted under 35 U.S.C. 154(b) by 813 days.

(21) Appl. No.: 13/480,004

(22) Filed: May 24, 2012

Related U.S. Application Data

(60) Provisional application No. 61/490,571, filed on May 26, 2011.

(51) Int. Cl.

| | |
|---|---|
| ***E02B 7/42*** | (2006.01) |
| ***E02B 7/40*** | (2006.01) |
| ***B25B 27/02*** | (2006.01) |
| ***D06B 23/04*** | (2006.01) |
| ***B25B 27/00*** | (2006.01) |

(52) U.S. Cl.
CPC ... *E02B 7/42* (2013.01); *E02B 7/40* (2013.01); *B25B 27/00* (2013.01); *B25B 27/02* (2013.01); *D06B 23/047* (2013.01); *Y10T 29/49815* (2015.01); *Y10T 29/49817* (2015.01); *Y10T 29/49821* (2015.01); *Y10T 29/49822* (2015.01)

(58) Field of Classification Search
CPC ..... E02B 7/40; E02B 7/42; B25B 27/00; B25B 27/02; D06B 23/047; Y10T 29/49815; Y10T 29/49817; Y10T 29/49821; Y10T 29/49822; Y10T 29/49824
USPC ..... 29/426.1, 426.2, 426.4, 426.5, 426.6; 405/97, 90, 94, 99, 100
See application file for complete search history.

(56) References Cited

U.S. PATENT DOCUMENTS

| | | | | |
|---|---|---|---|---|
| 1,275,499 | A * | 8/1918 | Thorsby | 405/100 |
| 2,186,131 | A * | 1/1940 | Young | 405/100 |
| 2,322,846 | A * | 6/1943 | Growdon et al. | 405/93 |

(Continued)

OTHER PUBLICATIONS

WHECO; Rehabilitation of Trunnion Assemblies; Aug. 2, 2002; Water Power and Dam Construction; pp. 1-6.*
John Behrens for the USACE; Tainter Gate Trunnion Pin and Bushing Replacement: Mississippi River Lock 11; Powerpoint Presentation; Feb. 20, 2013; Slides 1-35.*
USACE; Attachment B: Removal and Installation Procedure; May 27, 2010; pp. 1-17.*
Cost Proposal for Contract Adjustment CA006 "Tainter Gates 2,9,10 Trunnion Pins and Bushings Replacement" to Rock Island District—Army Corps of Engineers; J.F. Brennan Co. Inc.; Aug. 28, 2009; 15 pages (redacted).

(Continued)

*Primary Examiner* — David Bryant
*Assistant Examiner* — Bayan Salone
(74) *Attorney, Agent, or Firm* — Whyte Hirschboeck Dudek S.C.

(57) ABSTRACT

Methods and systems for use in the removal of trunnion pin sleeves and the supporting of lock and/or dam gate structures (e.g., tainter or roller gates) are disclosed herein. In one example embodiment, a method of trunnion pin sleeve removal includes causing either a constriction of at least one part of the sleeve or an application of a torque with respect to the at least one part of the sleeve, and subsequently applying a force to the at least one part of the sleeve so as to pull out the sleeve. Also, in another example embodiment, a system for supporting a lock and/or dam gate assembly includes a support assembly having a at least one pedestal assembly. The support assembly further includes a trunnion arm support structure, configured to be supported at least in part by the at least one pedestal assembly and to at least partially support a trunnion arm.

22 Claims, 24 Drawing Sheets

(56) References Cited

U.S. PATENT DOCUMENTS

| | | | | | |
|---|---|---|---|---|---|
| 2,617,263 | A | * | 11/1952 | Hill | 405/100 |
| 2,705,871 | A | * | 4/1955 | Kenigsberg | 405/100 |
| 2,871,664 | A | * | 2/1959 | Dobell | 405/100 |
| 2,909,899 | A | * | 10/1959 | Ramsden et al. | 405/100 |
| 2,947,074 | A | * | 8/1960 | Newman | 29/280 |
| 3,336,756 | A | * | 8/1967 | Isenberg et al. | 405/100 |
| 3,505,822 | A | * | 4/1970 | Schulz | 405/100 |
| 4,146,346 | A | * | 3/1979 | Salo | 405/80 |
| 4,394,098 | A | * | 7/1983 | Wirschal et al. | 405/77 |
| 4,648,742 | A | | 3/1987 | Strecker | |
| 5,516,230 | A | * | 5/1996 | Bargeron et al. | 405/100 |
| 5,638,909 | A | * | 6/1997 | Henderson | 173/211 |
| 6,171,023 | B1 | * | 1/2001 | Townshend | 405/94 |
| 6,524,031 | B2 | * | 2/2003 | Carter et al. | 405/184.3 |
| 6,524,051 | B2 | * | 2/2003 | Nering | 414/331.01 |
| 7,210,670 | B2 | * | 5/2007 | Franks | 254/294 |
| 7,578,636 | B2 | * | 8/2009 | Tjader | 405/184.3 |
| 8,167,519 | B2 | * | 5/2012 | Ebert et al. | 408/95 |
| 8,876,430 | B1 | * | 11/2014 | Steiber et al. | 405/100 |
| 2002/0152599 | A1 | * | 10/2002 | Pai | 29/426.1 |
| 2004/0009041 | A1 | * | 1/2004 | Aughton et al. | 405/99 |
| 2006/0083592 | A1 | * | 4/2006 | Aughton et al. | 405/100 |
| 2007/0253774 | A1 | * | 11/2007 | Aughton et al. | 405/100 |
| 2012/0207556 | A1 | * | 8/2012 | Ebert et al. | 408/10 |
| 2013/0067746 | A1 | * | 3/2013 | Wagstaff et al. | 29/897.1 |
| 2013/0205561 | A1 | * | 8/2013 | Fanourgiakis et al. | 29/426.5 |

OTHER PUBLICATIONS

Purchase Order to Minn. Conc. Sawing & Drilling; J.F. Brennan Co. Inc.; Nov. 5, 2009; 5 pages (redacted).

Engineering Drawings—U.S. Army Corps of Engineers, Rock Island, IL ; Jun. 2008; 3 pp.

Engineering Drawing—The R.C. Mahon Company, Detroit, MI; Jun. 2008; 1 p.

Preliminary inquiry regarding feasibility of core drilling this depth of steel; K2 Diamond; Jun. 30, 2009; 2 pp.

Removal and Installation Procedure—Submission of USACE; May 27, 2010; 17 pp.

E-mail correspondence, including attachments, between J.F. Brennan and Army Corps of Engineers, dated May 19, 2010 (attachments as of that date), and Feb. 14, 2014 (attachments also forwarded again on that date), 4 pages.

Documentation concerning Solicitation No. W912EK-08-0015 of U.S. Army Corps of Engineers, Jun. 26, 2008, 52 pages.

RFIs on Coring Bracket—Submission to USACE as RFI-0022, Jun. 17, 2010 (5 pages) and as RFI-0025, Aug. 10, 2010 (2 pages) 8 pages total.

U.S. Office Action for U.S. Appl. No. 13/479,924 dated Apr. 23, 2014, 6 pages.

U.S. Office Action for U.S. Appl. No. 13/479,924 dated Aug. 16, 2013, 8 pages.

* cited by examiner

SYSTEMS AND METHODS FOR REMOVAL OF TRUNNION PIN SLEEVE AND FOR SUPPORTING TAINTER GATE DURING SAID REMOVAL

CROSS REFERENCE TO RELATED APPLICATIONS

This application claims the benefit of U.S. provisional patent application No. 61/490,571 filed on May 26, 2011 and entitled "Systems and Methods for Removal of Trunnion Pin Sleeve and for Supporting Tainter Gate During Said Removal", which is hereby incorporated by reference herein.

FIELD OF THE INVENTION

The present invention relates to tainter gate assemblies as are commonly employed in dams and/or locks and the maintenance and refurbishment of same and, more particularly, to one or more of methods of removing a trunnion pin sleeve during a trunnion pin removal/replacement process, related methods pertaining to core drill assembly, a gate support structure for use with lock and/or dam gates, and methods of assembling, installing and/or using the same.

BACKGROUND OF THE INVENTION

Tainter gates are commonly employed in dams and canal locks, along the Mississippi River and elsewhere, to control water flow. Typically, tainter gates are floodgates having convex surfaces on the upstream sides of the gates, such that the flow of water toward and by the gates can assist in the opening and closing of the gates. A conventional tainter gate includes a pair of arms that are rotatably supported by way of shafts or "trunnion pins" that extend out of the tainter gate supports or "trunnion boxes" attached to the downstream sides of the dam piers on opposite sides of the tainter gate. The trunnion pins particularly pass through, and are supported on, two (or possibly more) anchor plates of the trunnion boxes.

Rotation of the tainter gate relative to the trunnion boxes (and thus relative to the river or other body of water and relative to the environment generally) particularly is accomplished at least in part by virtue of the rotation of trunnion pin bushings formed inside the casting of the arms through which pass the trunnion pins, relative to the trunnion pins themselves. That is, the trunnion pin bushings rotate relative to the trunnion pins when the tainter gate is raised or lowered. The overall combination of a tainter gate along with the associated trunnion boxes (including anchor plates) and trunnion pins and bushings, can be referred to as a tainter gate assembly or tainter gate structure.

Many tainter gate assemblies along the Mississippi River were installed in the 1930s and 1940s and, due to their age and correspondent wear and tear, are in need of repair. This is especially true of certain moving parts of the tainter gate assemblies. More particularly in this regard, the trunnion pins and/or trunnion pin bushings of many tainter gate assemblies are corroded such that the trunnion pin bushings cannot rotate freely relative to the trunnion pins. In such circumstances rotation of the tainter gate relative to the trunnion boxes will still occur, but largely (or entirely) only due to rotation of the trunnion pin bushings themselves relative to the orifices in the tainter gate arms in which the bushings are positioned. Over time, such rotation of the bushings within the tainter gate arms is undesirable, because it can damage the interfaces between the bushings and the tainter gate arms (and particularly the surfaces of the orifices of the arms in which the bushings are situated) as well as damage the interfaces between the bushings and trunnion pins. Damage to the interfaces particularly can occur due to misalignment of lubricant pathways formed along the junctions of the bushings and trunnion castings and/or a failure of lubricant to be provided along the junctions as a result of relative movement between the bushings and castings. Further, damage can occur even if the trunnion pins rotate relative to the anchor plates of the trunnion boxes, particularly if the trunnion pins are corroded.

Given these concerns, there is newfound interest in reconditioning many existing tainter gate assemblies, and particularly in replacing existing trunnion pins and trunnion pin bushings with new pins and bushings. Yet removal of trunnion pins from the trunnion boxes, particularly when the trunnion pins are corroded, has proven to be difficult. Replacement of the trunnion pins is complicated by the necessity of maintaining the integrity of the trunnion box and the anchor plates therewithin. In at least some circumstances, it is necessary that the trunnion pins be removed without employing extreme temperature changes that could affect the thermodynamic properties of the pin or anchor plate material (which could potentially damage the anchor plate material). Also, in at least some circumstances, it is necessary that trunnion pin removal be accomplished without the use of excessive jacking force, again to avoid damage to the anchor plates.

Recently, it has been determined that core drilling of the trunnion pins can be employed for the purpose of facilitating the removal of trunnion pins. Core drilling involves drilling out a core or central region of a trunnion pin along the entire length of the pin, while leaving an exterior sleeve portion of the original trunnion pin (or simply the "pin sleeve") in place within the trunnion box (and anchor plates) for removal by way of a separate process. Use of core drilling in this manner is theoretically desirable because it does not require that any significant temperature changes be applied to the trunnion pin or trunnion box, nor does it require the application of any significant jacking force. Indeed, assuming pin sleeve removal is straightforward, the use of core drilling allows for careful removal of a trunnion pin in a manner that avoids damage to the trunnion box (and anchor plates thereof), and reduces the total cost of pin removal.

Yet core drilling in this manner is not fully satisfactory because removal of the pin sleeve in fact can itself be a difficult process. In particular, due to corrosion of the trunnion pin along its exterior surface that is in contact with the trunnion box (and anchor plates thereof) and trunnion bushing, removal of the pin sleeve typically cannot be accomplished simply by applying an axial force to the pin sleeve to draw it out of the trunnion box and trunnion bushing.

Further, supporting a core drill in relation to a trunnion pin to be drilled also is not straightforward. In particular, it is typically undesirable to mount core drill machinery upon a pier (or other structure) adjacent to the trunnion pin because typically there is too great of a distance between the mounting location and the drilling location to achieve satisfactory control over the drilling.

In addition to the above concerns, trunnion pin removal/replacement is also complicated because, when removing trunnion pins and bushings from tainter gate assemblies, it is necessarily the case that the tainter gates themselves be decoupled from the supports (their anchors) and must be supported in some other manner. However, the use of barges to perform support can be undesirable because, due to surging and/or changing water elevations, the elevation of the tainter gate will typically not remain steady. Further, supports positioned onto a river bottom can also be difficult to install because of diving equipment and unpredictable or undesirable surface conditions along the river bottom.

For at least these reasons, therefore, it would be advantageous if new or improved systems and/or methods can be developed for enabling the reconditioning of tainter gate assemblies and particularly for facilitating the removal and/or replacement of pin sleeves of trunnion pins following core drilling of those pins (and/or for supporting the core drilling machinery), and/or for supporting the tainter gates during such processes and/or at other times.

SUMMARY OF THE INVENTION

In at least some example embodiments, the present invention relates to a method of removing a trunnion pin sleeve from one or more support structures associated with a tainter gate subsequent to a performing of a core drilling operation upon a trunnion pin, the trunnion pin sleeve being a remainder of the trunnion pin following the performing of the core drilling operation. The method includes causing either a constriction of at least one part of the trunnion pin sleeve in a substantially inward manner relative to a central axis of the trunnion pin sleeve, or an application of a torque with respect to the at least one part of the trunnion pin sleeve substantially about the central axis. The method additionally includes, following the causing, applying a force to the at least one part of the trunnion pin sleeve so that the at least one part of the trunnion pin sleeve is pulled out from the one or more support structures.

In at least some further example embodiments, the present invention relates to a method of removing a trunnion pin sleeve from one or more support structures associated with a tainter gate subsequent to a performing of a core drilling operation upon a trunnion pin, the trunnion pin sleeve being a remainder of the trunnion pin following the performing of the core drilling operation. The method includes (a) either (i) causing a constriction of the trunnion pin sleeve in a substantially inward manner toward a central region of the trunnion pin sleeve by way of one or both of a welding operation and an introduction of a cooling material within the trunnion pin sleeve, or (ii) core drilling a trunnion bushing within which the trunnion pin sleeve extends. The method further includes (b) applying a force generally along a central axis of at least a remainder portion of the trunnion pin sleeve so that the remainder portion is pulled out from the one or more support structures.

In at least some additional example embodiments, the present invention also includes or relates to processes for setting up a core drill assembly. In some such cases, the core drill assembly can be used to core drill a trunnion bushing employed in relation to a trunnion pin.

In at least some additional example embodiments, the present invention relates to a method of removing a trunnion pin sleeve from one or more support structures associated with a tainter gate subsequent to a performing of a core drilling operation upon a trunnion pin, the trunnion pin sleeve being a remainder of the trunnion pin following the performing of the core drilling operation. The method comprises (a) either (i) causing a constriction of the trunnion pin sleeve in a substantially inward manner toward a central region of the trunnion pin sleeve by way of one or both of a welding operation and an introduction of a cooling material within the trunnion pin sleeve, or (ii) core drilling a trunnion bushing within which the trunnion pin sleeve extends; and (b) applying a force generally along a central axis of at least a remainder portion of the trunnion pin sleeve so that the remainder portion is pulled out from the one or more support structures.

In at least some further example embodiments, the present invention relates to a support assembly that includes at least one pedestal assembly. The support assembly further includes a trunnion arm support structure, configured to be supported at least in part by the at least one pedestal assembly and to at least partially support a trunnion arm of a lock and/or dam gate assembly.

Further, in at least some additional example embodiments, the present invention relates to a support assembly for use with a lock and/or dam type gate assembly having a pair of trunnion arms connectable to a pier or similar structure. The support assembly includes a pair of pedestal assemblies each including a beam or beam-like structure and a plate or plate-like structure, the plate or plate-like structure configured to rigidly secure a respective one of the pair of pedestal assemblies to the pier or similar structure. The support assembly also includes a trunnion arm support structure, configured to be supported at least in part by the pair of pedestal assemblies and to at least partially support a lower trunnion arm. Each of the pair of pedestal assemblies includes a cantilevered portion that is configured to extend over an edge of a pier or similar structure and receive, so as to support, a portion of the trunnion arm support structure.

In at least some further example embodiments of support assemblies, one or more jack devices (e.g., hydraulic cylinders) are employed to allow horizontal and/or vertical adjustments to be made with respect to the gate structure.

Additionally, in at least some example embodiments, the present invention relates to a method of using a support assembly. The method includes providing a pair of pedestal assemblies and a trunnion arm support structure. The method also includes positioning the trunnion arm support structure in relation to the pair of pedestal assemblies and a trunnion arm of a lock and/or dam gate assembly so that the trunnion arm support structure is supported at least in part by the pair of pedestal assemblies and is further so that the trunnion arm support structure at least partially supports the trunnion arm of the lock and/or dam gate assembly.

Still further, in at least some example embodiments, the present invention relates to a method of supporting a trunnion arm of a lock and/or dam gate assembly. The method includes: providing a support assembly comprising at least one pedestal assembly and a trunnion arm support structure; positioning the at least one pedestal assembly in relation to a pier; positioning the trunnion arm support structure in relation to the at least one pedestal assembly so that the trunnion arm support structure is supported at least in part by the at least one pedestal assembly; and positioning a trunnion arm of a lock and/or dam gate assembly so that the trunnion arm support structure at least partially supports the trunnion arm of the lock and/or dam gate assembly.

BRIEF DESCRIPTION OF THE DRAWINGS

Features of the present disclosure which are believed to be novel are set forth with particularity in the appended claims. Embodiments of the disclosure are disclosed with reference to the accompanying drawings and are for illustrative purposes only. The disclosure is not limited in its application to the details of construction or the arrangement of the components illustrated in the drawings. The disclosure is capable of other embodiments or of being practiced or carried out in other various ways. Like reference numerals are used to indicate like components. In the drawings:

DETAILED DESCRIPTION

Figure 1:
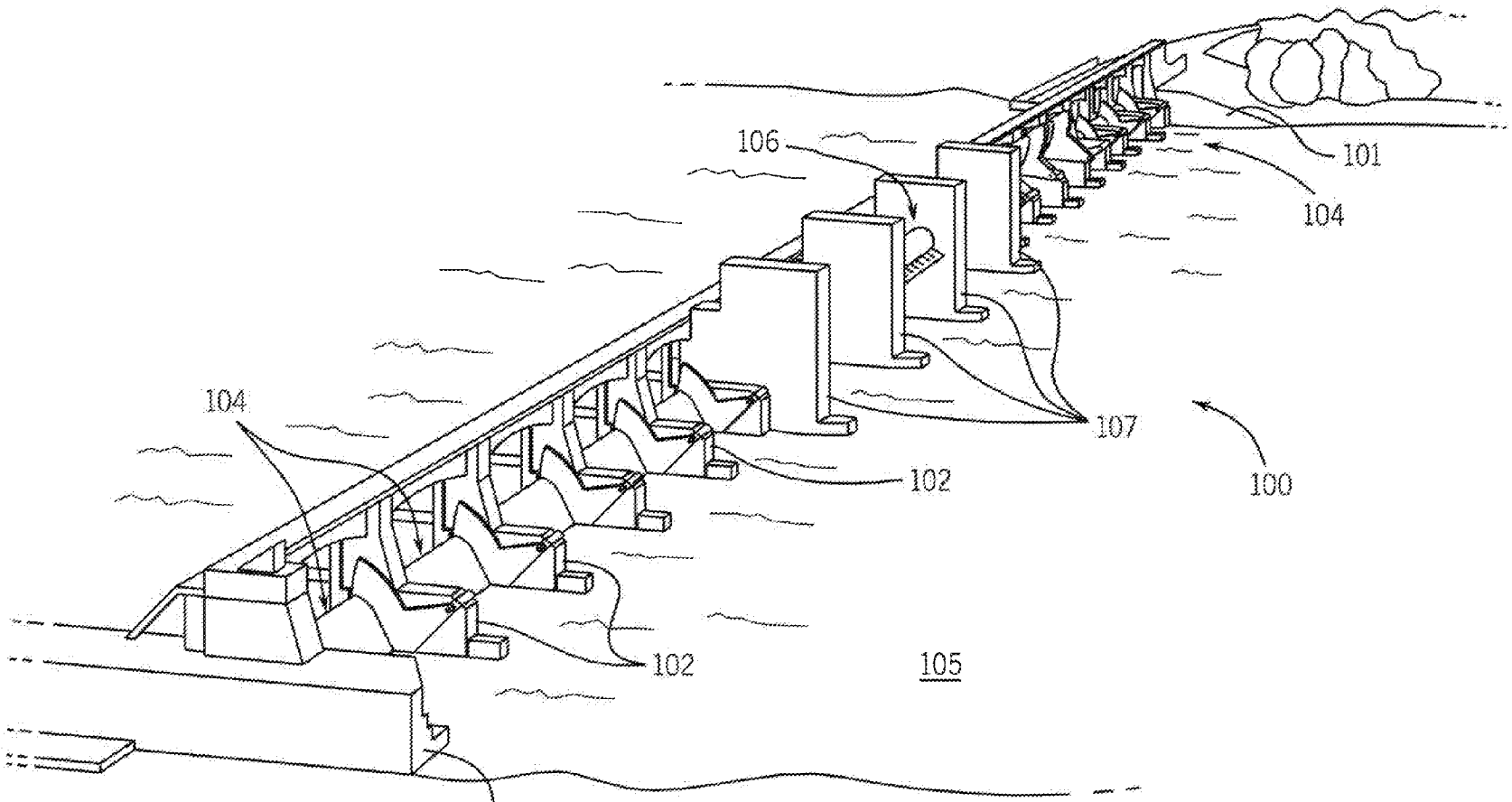
FIG. 1 is a side perspective view illustrating an example dam with one or more tainter gates and one or more roller gates.

Referring to FIG. 1, an example dam 100 is shown as is commonly found along major waterways such as the Mississippi River. A perspective view of the dam 100 shows the dam, among other things, as including multiple abutment walls (or piers) 101 at opposite ends of the dam 100, multiple tainter gate piers 102, multiple roller gate piers 107, multiple tainter gates 104, and multiple roller gates 106 (one of which is visible). Each of the roller gates 106 is positioned between a respective pair of the piers 107. By comparison, each of the tainter gates 104 is positioned either between a respective pair of the tainter gate piers 102, positioned between one of the tainter gate piers 102 and one of the roller gate piers 107, or positioned between one of the tainter gate piers 102 and one of the abutment walls 101. The tainter gates 104 can respectively be considered to form respective portions of respective tainter gate assemblies that, as discussed further below, allow for the respective tainter gates to be raised or lowered depending upon the environmental conditions. Likewise, the roller gates 106 can respectively be considered to form respective portions of respective roller gate assemblies that allow for roller gate operations depending upon the environmental circumstances. The tainter gates 104 and roller gates 106 can be of conventional design. As is known, the tainter gates 104 and roller gates 106 can be lowered or raised to prevent or allow the flow of water 105 past the dam 100.

Figure 2A:
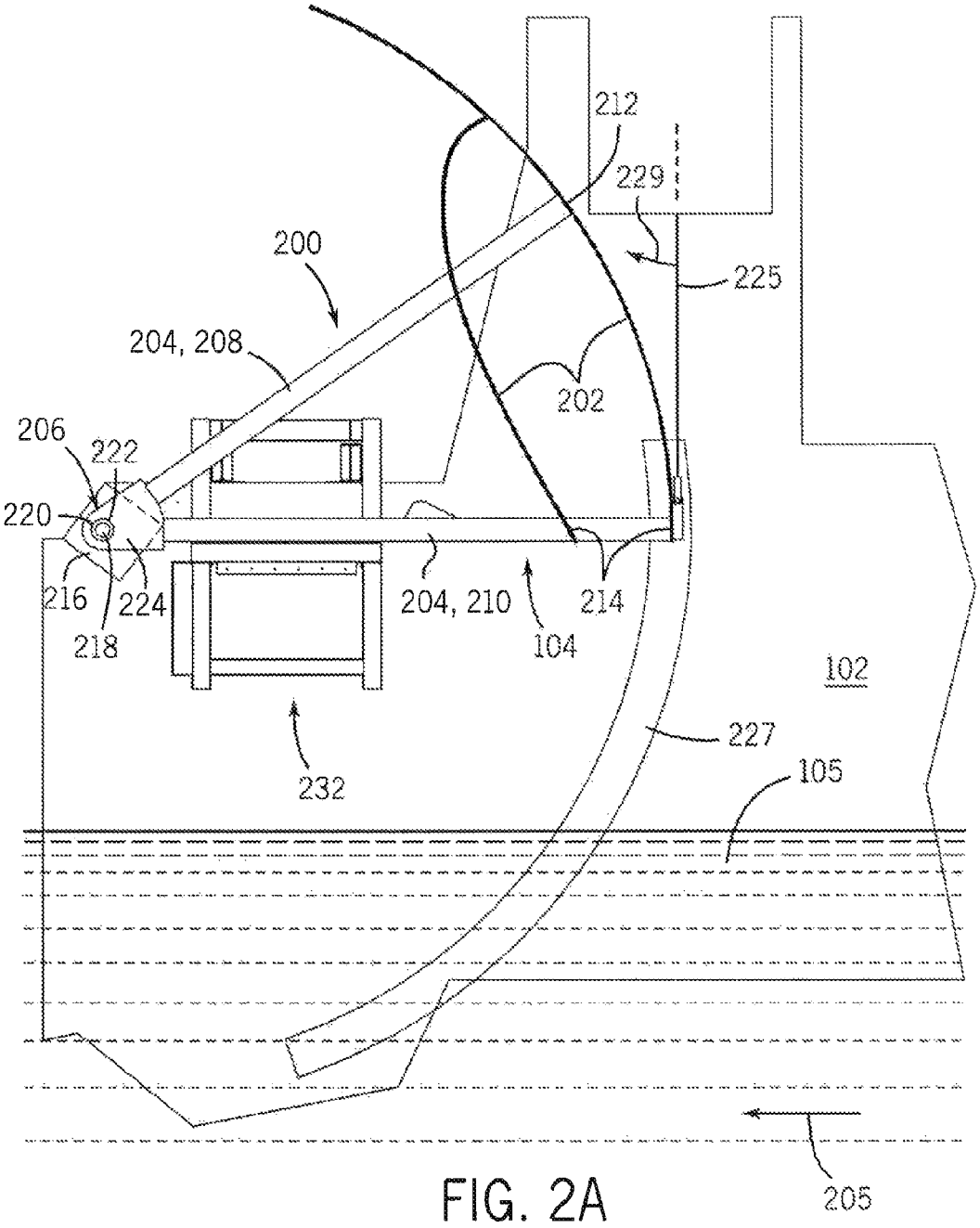
FIG. 2A is a side elevation view of a tainter gate assembly provided in relation to a pier along with an example support assembly (or structure or bracket) employed to support the tainter gate assembly during a process of trunnion pin removal/replacement.

Turning to FIG. 2A, a side elevation view is provided of an example tainter gate assembly 200 including one of the tainter gates 104 of FIG. 1, shown in relation to one of the tainter gate piers 102. As illustrated, tainter gate 104 of the tainter gate assembly 200 includes a gate portion 202 that serves as the barrier for preventing water flow when the tainter gate 104 is lowered so as to be in a closed position, albeit in FIG. 2A the tainter gate is shown to be in a raised or opened position. It should be appreciated that FIG. 2A particularly shows a cross-section of the gate portion 202, and that in reality the gate portion actually extends horizontally (out of the page when viewing FIG. 2A) between the pier 102 that is shown in FIG. 2A and an additional one of the tainter gate piers (or one of the roller gate piers 107 or abutment walls 101) on the opposite side of the tainter gate 104 in relation to which the tainter gate is also supported.

Additionally, the tainter gate 104 of the tainter gate assembly 200 includes trunnion arms 204 linking the gate portion 202 to a pivot location or trunnion location 206 of the tainter gate 104. More particularly, the trunnion arms 204 include an upper trunnion arm 208 and a lower trunnion arm 210. The upper trunnion arm 208 links an upper (or at least middle) region 212 of the gate portion 202 with the trunnion location 206, while the lower trunnion arm 210 links a lower region 214 of the gate portion 202 with the trunnion location 206. During operation, the tainter gate 104 serves to allow or preclude flow of the water 105 past the gate. Conventionally, the gate portion 202 is orientated to face outward towards the water 105 that is upstream of the tainter gate 104. Consequently, when the tainter gate 104 is opened, the water 105 generally tends to flow past the tainter gate (and the dam 100) in a direction from the gate portion 202 toward the trunnion location 206, as represented by an arrow 205. Also, given the convex shape of the gate portion 202 along its upstream surface and the positioning of the trunnion arms 208 and 210, the tainter gate 104 from the side appears to take the shape of a sector or wedge.

Further as shown in FIG. 2A, the tainter gate assembly 200 in addition to the tainter gate 104 itself also includes several support components upon which the tainter gate 104 is rotatably supported. Although the support components can be considered part of the tainter gate or alternatively be considered distinct from but associated with the tainter gate, for purposes of the present description these components are considered part of the tainter gate assembly 200 rather than specifically part of the tainter gate 104. More particularly in this regard, these support components include a trunnion support structure or housing or "trunnion box" 216 that in turn is supported upon the pier 102. Further, these additional support components include a trunnion pin 218 that is supported within the trunnion box (and as further discussed below) and a trunnion bushing 220 that is an annular structure fitting within a complementary orifice 222 formed at a trunnion casting 224 that is a vertex or junction of the trunnion arms 208, 210 at the trunnion location 206.

Additionally, FIG. 2A also shows a hoist chain 225 that is attached to the gate portion 202 and serves as the mechanism by which the trunnion gate 104 is raised (lifted) and lowered (an electric or other motor or engine or actuator, not shown, retracts or allows the hoist chain to be lengthened so as to achieve operation in this regard). It will be understood also that, when lowered, the gate portion 202 (due to its curved shape) follows an arc path 227 (formed by a side seal rub plate of one of the piers 102 or an outside face of one of the outermost piers 107 or abutment walls 101) down into the water 105. Correspondingly, as this occurs, the hoist chain 225 ceases to be exactly vertical but becomes increasingly slanted, as represented by an arrow 229 (this can also be referred to as a shift in the fleeting angle of the hoist chain, and this shift can commonly vary from vertical by about 5.1 degrees between when the tainter gate is fully raised to when the lower trunnion arm 210 is level).

Figure 2B:
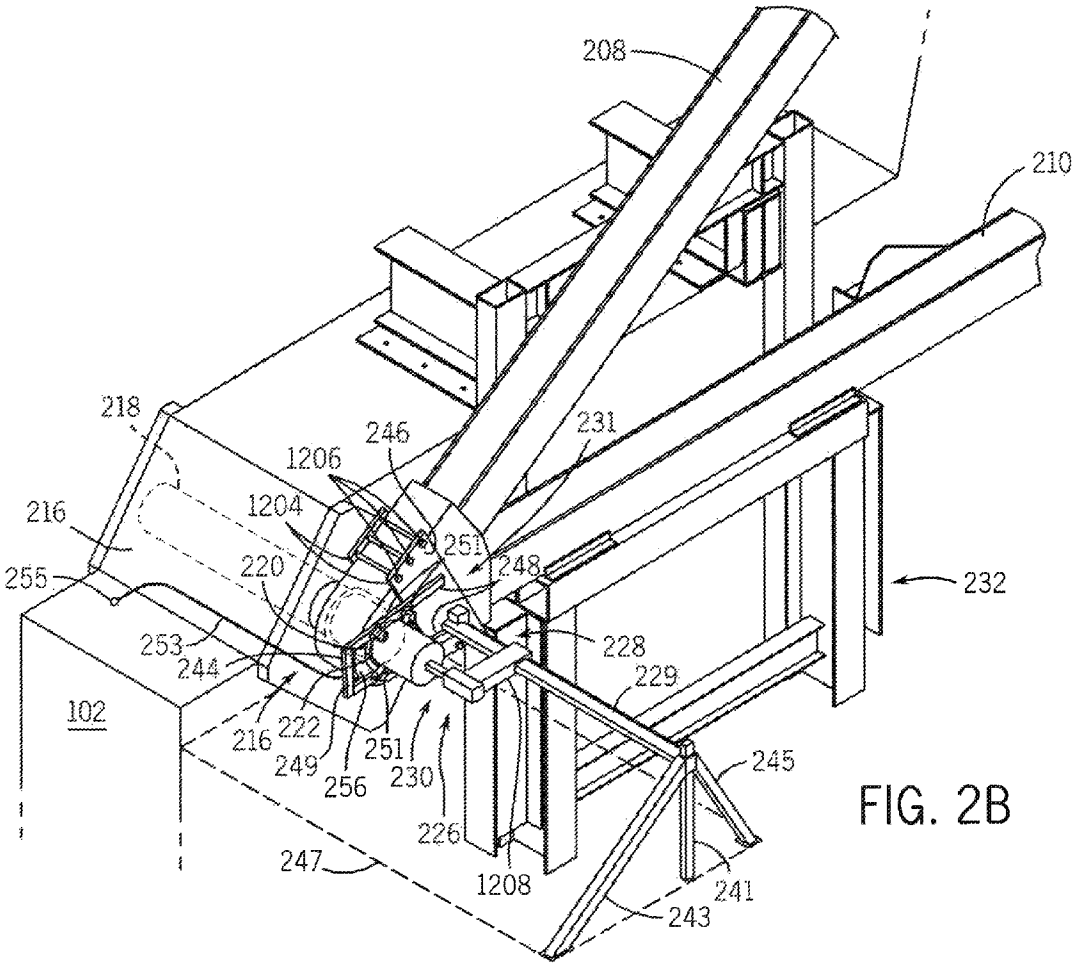
FIG. 2B is a further side perspective view of portions of the tainter gate assembly shown in FIG. 2A, additionally showing a core drill assembly (including a support assembly for a core drill) employed in core drilling a trunnion pin of the tainter gate assembly.

Also, referring additionally to FIG. 2B, certain portions of the tainter gate assembly 200 of FIG. 2A are shown in more detail in a cutaway perspective view. As illustrated in FIG. 2B (partially in phantom), the trunnion pin 218 extends out from the trunnion box 216 and in turn passes through the trunnion bushing 220 (through the middle thereof), such that the trunnion arms 208, 210 are supported upon the trunnion pin 218 via the trunnion bushing 220, and thus further supported in relation to the pier 102 by way of the trunnion box 216 supporting the trunnion pin.

Further with respect to FIGS. 2A-2B, and also FIGS. 3 and 12, several additional components are shown that are employed during a trunnion pin removal/replacement process as will be described further below. It should be appreciated that these components are shown in one or more of FIGS. 2A, 2B, 3, and 12 for convenience of description, but that these components are not present during normal operation of the tainter gate assembly 200. More particularly in this regards, FIG. 2B further shows a core drill assembly 226 having a support assembly 228 on which is supported a core drill 230. The core drill assembly 226 (and support assembly 228 and core drill 230 thereof) are not part of the tainter gate assembly 200 but rather are additional components that, as discussed further below, are employed to core drill the trunnion pin 218 (and, in some embodiments, possibly also to core drill the trunnion bushing 220) during part of a trunnion pin removal/replacement process. Also, FIGS. 2A and 2B further show a tainter gate support structure or assembly 232 that is employed to support (at least in part) the tainter gate assembly 200 during the trunnion pin removal/replacement process.

Further with respect to the core drill assembly 226 and the support assembly 228 thereof, as shown in FIG. 2B the core drill assembly 226 more particularly includes a support arm (which can also be referred to as a core drill mast or boom) 229 extending from an attachment assembly 231, which is also part of the core drill assembly, and by which the entire core drill assembly 226 (and the support assembly 228 thereof) is attached to and supported by the trunnion arms 208, 210. As shown, the support arm 229 is a beam upon which an extension arm 1208 of the core drill 230 can be slidably supported (that is, allowing for translational motion of the core drill as discussed further below with respect to FIGS. 3-4D). Additionally as shown, in the present embodiment, a far end of the support arm 229 away from the attachment assembly 231 is further supported by a core drill mast rear support including a support bracket (which can also be referred to as a rear support bracket or vertical support) 241, and also a first lateral stabilizer 243 and a second lateral stabilizer 245.

Each of the support bracket 241 and lateral stabilizers 243, 245, in addition to being attached (by way of respective upper ends of those structures) to the far end of the support arm 229, is also attached (by way of respective lower ends of those structures) to a platform 247 that is attached to and extends outward from the pier 102. The platform 247, which in FIG. 2B is shown in phantom so as to allow for a clearer presentation of other structures, is in the present embodiment a planar structure providing a floor or support along which work personnel can walk and work to perform a trunnion pin removal/replacement process as described in further detail below. The support bracket 241 and lateral stabilizers 243, 245 more particularly can be attached to the platform by way of tack welding or other fastening or attachment processes or mechanisms (e.g., screws). For purposes of description, the attachment assembly 231, support arm 229, support bracket 241, and lateral stabilizers 243, 245 forming the core drill mast rear support can all be considered portions of the support assembly 228 and thus part of the core drill assembly 226. Although the platform 247 can also be considered part of the support assembly 228 (and the core drill assembly 226), it can also be considered an independent structure that is not part of the support assembly or core drill assembly, since in some cases the platform can be present even though no core drilling is envisioned.

The support bracket 241 and lateral stabilizers 243, 245 forming the core drill mast rear support serve to prevent, counteract, or limit vibration, sagging, torquing, and lateral movement of the support arm (core drill mast) 229, which might otherwise occur, particularly during use of the core drill 230, for example, when pressure is placed upon the drill bit as the core drill advances during the core drilling process. It should be appreciated that, in other embodiments, the support bracket 241 and lateral stabilizers 243, 245 forming the core drill mast rear support need not be present and rather the support arm 229 can be unsupported at its far end away from the attachment assembly 231. Also, in some alternate embodiments, the platform 247 need not be present or can take another form than that shown, for example, a form in which the platform does not extend outward away from the pier 102 to as great of an extent as the support arm or that does not form a platform that can support work personnel.

Figure 12:
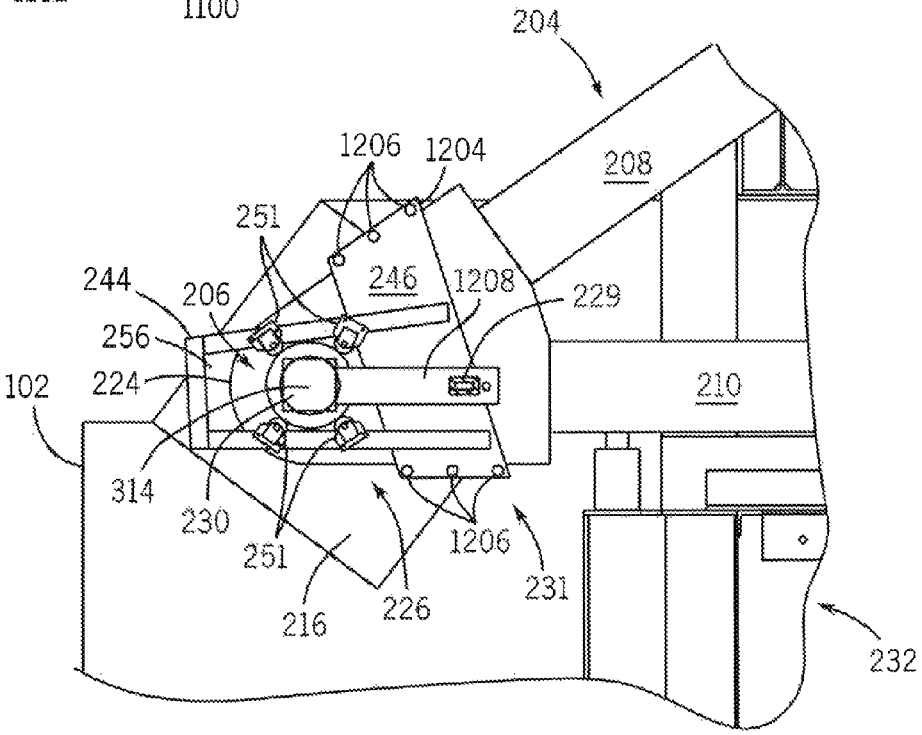
FIG. 12 particularly shows a side elevation view of portions of the tainter gate assembly and other structures shown in FIG. 2B, shown in cutaway, with a particular focus upon the core drilling assembly used to support the core drill and supported on the trunnion arms.

Referring additionally to FIG. 12 in addition to FIG. 2B (and FIG. 3), further components of the core drill assembly 226 and the support assembly 228 are shown, particularly components associated with or proximate to the attachment assembly 231. In particular, FIGS. 12 and 2B show the attachment assembly 231 as including attachment plates 1204 and coupling bolts 1206 by which those attachment plates can be coupled together and tightened with respect to one another. It should be understood, particularly from FIG. 2B, that there are two of the attachment plates 1204 in the present embodiment, and that tightening of the coupling bolts 1206 particularly allows the attachment plates to be tightened against opposite sides of the trunnion casting 224 (about both of the trunnion arms 208, 210), so as to achieve attachment of the attachment assembly 231 to the trunnion arms.

It should be noted also that, in the present embodiment, the attachment plates 1204 have outer perimeters that are substantially trapezoidal in shape so as to follow the contours of the trunnion arms 208, 210 at the casting 224 (in other embodiments, the shape of the attachment plates need not be trapezoidal but can be of any other arbitrary shape suitable to facilitate contact with the trunnion arms). The attachment plates 1204 in the present embodiment are located as close to the trunnion location 206 as possible without overlapping that trunnion location, so that the distance between the support location for the core drill 230 and a central axis 314 of the trunnion pin 218 (e.g., the distance between the support arm 229 and the central axis 314) is minimized.

Additionally as shown in FIG. 12 (as well as in FIGS. 2B and 3), in addition to the attachment plates 1204 and coupling bolts 1206, in the present embodiment the attachment assembly 231 further includes several additional components mounted upon and supported by that one of the attachment plates from which the support arm 229 extends (that is, the one of the attachment plates that is on the side of the trunnion arms 208, 210 on which is positioned the core drill 230, rather than the other of the attachment plates that is positioned between the trunnion arms and the pier 102), which is shown in FIGS. 12 and 2B as an outer attachment plate 246. More particularly, in the present embodiment, a C-shaped bracket (or simply "C-bracket") 244 is attached to that outer attachment plate 246, with two arms 248 of the C-bracket being respectively welded or otherwise attached to the outer attachment plate respectively at two locations and a further back bracket portion 249 connecting and extending substantially vertically between the two arms.

Additionally as shown, the C-bracket 244 overall extends in a direction parallel to the flat surface of the outer attachment plate 246 (which is also generally parallel to a plane formed by the two trunnion arms 208, 210) so as to extend around the perimeter of the trunnion pin 218, around the central axis 314 thereof. A space 256 is formed within the C-bracket 244, particularly between the two arms 248 of the C-bracket and between the back bracket portion 249 and the outer attachment plate 246, that is sufficiently large so as to allow the core drill 230 to proceed through the C-bracket through the space during the trunnion pin removal/replacement process and particularly the core drilling portion thereof (as described further below with respect to FIGS. 3-4D).

Further, mounted upon the two arms of the C-bracket 244 are four roller bearings 251. In the present embodiment, two of the roller bearings 251 are particularly mounted upon an upper one of the two arms 248 of the C-bracket 244 and two others of the roller bearings are mounted upon a lower one of the two arms 248 of the C-bracket, albeit in other embodiments the arrangement (and, indeed, the number) of roller bearings can be varied (for example, in another embodiment, there could be a single roller bearing positioned on each of the arms 248 and a third roller bearing positioned along the back bracket portion 249). The roller bearings 251 particularly are intended to engage the outer housing of the core drill bit as it proceeds through the space 256 within the C-bracket 244 during the trunnion pin removal/replacement process (and particularly a core drilling portion thereof), and to thereby prevent, counteract, or limit vibration/shifting of the core drill during that process (again as described further with respect to FIGS. 3-4D). The spacing of the roller bearings 251 relative to one another about the central axis 314 in the present embodiment is set so as to maintain alignment, or to facilitate substantial maintaining of the alignment, of the drill bit of the core drill 230 with that central axis (for example, in the present embodiment, the roller bearings 251 are spaced substantially equidistantly apart from one another around the central axis).

Further as shown particularly in FIG. 2B, in the present embodiment, additional support for the C-bracket 244 is provided by way of a come along 253 that extends from an attachment location 255 on the pier 102 and connects to the downstream end of the C-bracket, which in this example embodiment is the back bracket portion 249. Although shown as simply a wire extending between the back bracket portion 249 of the C-bracket 244 and the attachment location 255, it should be appreciated that the come along 253 typically includes a ratcheting-type mechanism (e.g., a ratchet or winch or turnbuckle) by which the tension of the wire, and thus the tension between the C-bracket 244 and the attachment location 255, can be adjusted and tightened. By virtue of the come along 253, vibration and movement of the C-bracket 244 can further be prevented, counteracted, or limited.

It should be appreciated that, although the attachment assembly 231 in the present embodiment includes the various components described above, in other embodiments one or more of these components need not be present or can be present in other forms. For example, in some alternate embodiments, the C-bracket 244, roller bearings 251, and come along 253 can be completely eliminated from the attachment assembly 231 and the core drill assembly 226 of which the attachment assembly forms a part. Or, in some alternate embodiments, the C-bracket 244 and roller bearings 251 can be present, but the come along 253 need not be present, or the C-bracket can take another form or shape.

Also it should be appreciated that, although FIGS. 2A-2B only show views of the tainter gate 104 and tainter gate assembly 200 at one side of the gate portion 202, the same (or substantially the same) or complementary components are found at the opposite end of the gate portion 202. That is, the tainter gate assembly 200 should be understood to include not merely the trunnion arms 208, 210 (and associated trunnion casting 224), the trunnion box 216, the trunnion pin 218 and trunnion bushing 222, but also an additional pair of trunnion arms (and associated trunnion casting) linking an opposite end of the gate portion 202 with an additional trunnion pin via an additional trunnion bushing with that additional trunnion pin being supported by an additional trunnion box (not shown). Given this to be the case, the tainter gate assembly 200 is symmetrical or substantially symmetrical.

As for the core drill assembly 226 and support assembly 232, similar assemblies (e.g., mirror images of the assemblies shown in FIG. 2B) can be employed in relation to the complementary components of the tainter gate assembly 200 at the opposite end of the gate portion 202 of the tainter gate assembly when the tainter gate assembly is undergoing the trunnion pin removal/replacement process (or possibly in other circumstances, such as during a tainter gate installation process, which could further involve trunnion pin installation). Otherwise, during normal operation of the tainter gate assembly 200, neither of the assemblies 226, 232 shown in FIGS. 2A-2B nor any corresponding other such assemblies at the opposite end of the tainter gate assembly are typically present.

Figure 3:
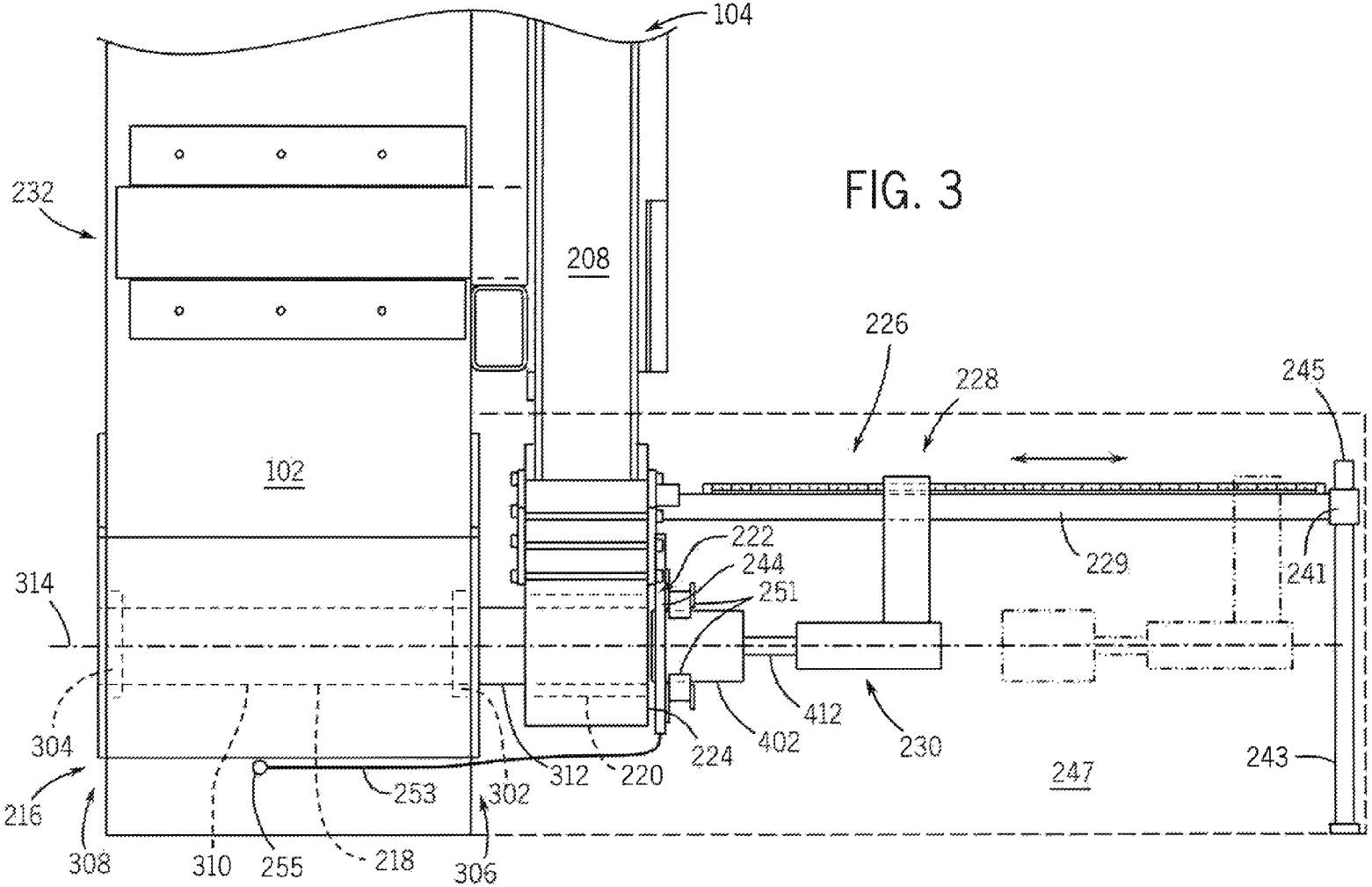
FIG. 3 is a top plan and partly-cutaway view of portions of the tainter gate assembly and core drill assembly of FIG. 2B, and particularly also showing (in phantom) the trunnion pin and a trunnion bushing of the tainter gate assembly.

Turning to FIG. 3, a top plan view of the tainter gate assembly 200 of FIG. 2B is shown. More particularly, FIG. 3 shows, in phantom, the trunnion pin 218 to be supported within (and to extend through) the trunnion box 216. More particularly in this regard, the trunnion pin 218 is shown to be supported by first and second anchor plates 302 and 304, respectively, which are shown in phantom and are respectively positioned at a first side 306 of the trunnion box 216 and a second side 308 of the trunnion box. The anchor plates 302, 304 can take a variety of forms depending upon the embodiment and, in at least some embodiments, can be annular bearings having orifices within their respective centers through which the trunnion pin 218 passes, and having exterior surfaces that are in contact with surrounding support surfaces of the trunnion box 216. Further as shown, the trunnion pin 218 particularly extends outward from the trunnion box 216 past the first side 306 and then through the trunnion bushing 220, which in turn is supported within the orifice 222 formed within the casting 224 of the trunnion arms 208, 210 (a cut away portion of the upper trunnion arm 208 particularly being visible).

Thus, as shown in FIG. 3, in the present embodiment a primary, longer portion 310 of the trunnion pin 218 is supported within the trunnion box 216 by way of the anchor plates 302, 304 while a secondary, shorter portion 312 of the trunnion pin extends out past the first side 306 of the trunnion box 216 and supports the tainter gate 104 by way of the trunnion bushing 220. It should be understood that, during usual operation, the tainter gate 104 is able to rotate about the central axis 314 of the trunnion pin 218 due to relative rotational motion of the trunnion bushing 220 about the trunnion pin 218. Nevertheless, in other circumstances relative motion can also occur between the trunnion bushing 220 and the trunnion arms 208, 210/casting 224 as well as between the trunnion pin 218 and the anchor plates 302, 304 and even possibly between the anchor plates 302, 304 and the remainder of the trunnion box 216 (albeit the anchor plates 302, 304 in the present embodiment particularly are not rotatable relative to the remainder of the trunnion box and in some embodiments do not even have an exterior surface that is circular that would permit such rotation relative to the trunnion box, and consequently the anchor plates typically are considered part of the trunnion box 216).

As mentioned above, for various reasons at some point during the life of the dam 100, trunnion pins such as the trunnion pin 218 in FIGS. 2A-3 employed in a tainter gate assembly such as the tainter gate assembly 200 need to be replaced, either separately or in conjunction with replacement of the trunnion bushing 220 (and further possibly in conjunction with replacement of one or more of the anchor plates 302, 304, although this is typically not the case, that is, the anchor plates are typically not replaced). Additionally as already mentioned, one manner of removing an existing trunnion pin involves core drilling the trunnion pin and then removing the remaining trunnion pin sleeve. FIGS. 4A-4D illustrate, by way of additional views corresponding to the top plan view of FIG. 3 but mostly shown in cross-section, four respective stages of an example process of core drilling of the trunnion pin 218. It should be noted that, although FIG. 3 (as with FIGS. 2B and 12) shows the C-bracket 244, roller bearings 251, and come along 253 discussed above, for simplicity of illustration FIGS. 4A-4D omit those components. Also, FIGS. 4A-4D are shown in cutaway such that the support bracket 241 and lateral stabilizers 243 and 245 (and also the platform 247) are not shown.

Figure 4A:
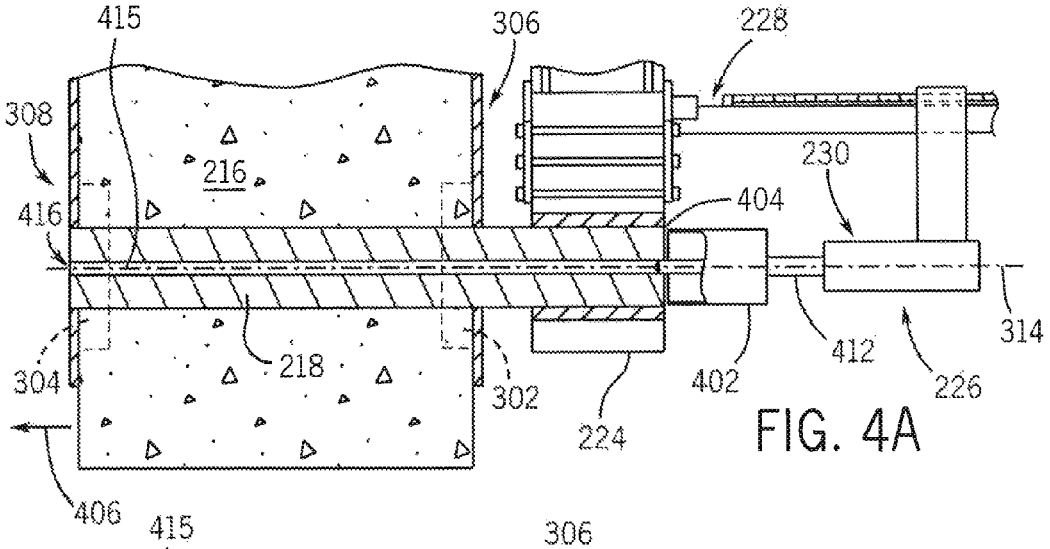
FIGS. 4A-4D respectively are four additional partly-cutaway views corresponding to the top plan and partly-cutaway view of FIG. 3, but mostly shown in cross-section, that particularly highlight four respective steps of an example process of core-drilling the trunnion pin of FIGS. 2A-3.

More particularly as shown, FIG. 4A shows an initial stage of a core drilling process in which the core drill 230 employs a first core drill bit 402 that is positioned adjacent a first end 404 of the trunnion pin 218 of FIG. 3 (the first end is the end of the trunnion pin that is visible at the exterior side of the casting 224 opposed to an interior side of the casting facing the trunnion box 216). It will be understood that the drill bit 402 is a cylindrical drill bit having a diameter that is slightly less than the diameter of the trunnion pin 218 and that is coaxially aligned with the trunnion pin 218 along the central axis 314 during the core drilling. Consequently, when the drill bit 402 drills into the trunnion pin 218 along a direction represented by an arrow 406 in FIG. 4A, the drill bit causes removal of a core (inner) portion of the trunnion pin 218 but does not cause removal of an outer sleeve portion of the trunnion pin and does not contact either the trunnion bushing 220 any of or the first and second anchor plates 302, 304 as the drill bit proceeds sufficiently far inward that it enters the trunnion box 216. Movement of the drill bit 402 along the arrow 406 is permitted by virtue of the core drill 230 being mounted on the support assembly 228 in a manner that permits translational (sliding) movement of the core drill 230 along the support assembly in a direction parallel to the arrow 406 and the central axis 314.

Figure 4B:
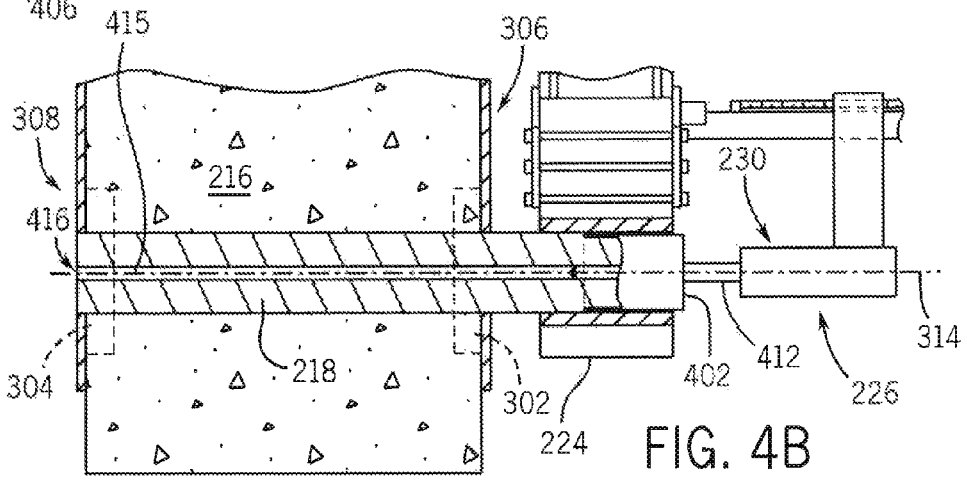

Due to the length of the trunnion pin 218, the core drilling operation proceeds in multiple stages (in this case, four stages corresponding to the respective FIGS. 4A-4D are shown) and, more particularly, multiple drill bits of different lengths are used at different stages to effectively remove different portions of the core of the trunnion pin 218 along its length. Any arbitrary number of drill bits can be used depending upon the embodiment or circumstance including, for example, three drill bits as discussed above, four drill bits, or another number of drill bits. FIG. 4A particularly shows the core drilling process just before the core drilling has begun, with the drill bit 402 not yet having significantly impinged the trunnion pin 218, while FIG. 4B shows the core drilling process at a time where the drill bit 402 has drilled as far (or nearly as far) into the trunnion pin 218 as it can prior to a new, longer drill bit being required (or desired).

Figure 4C:
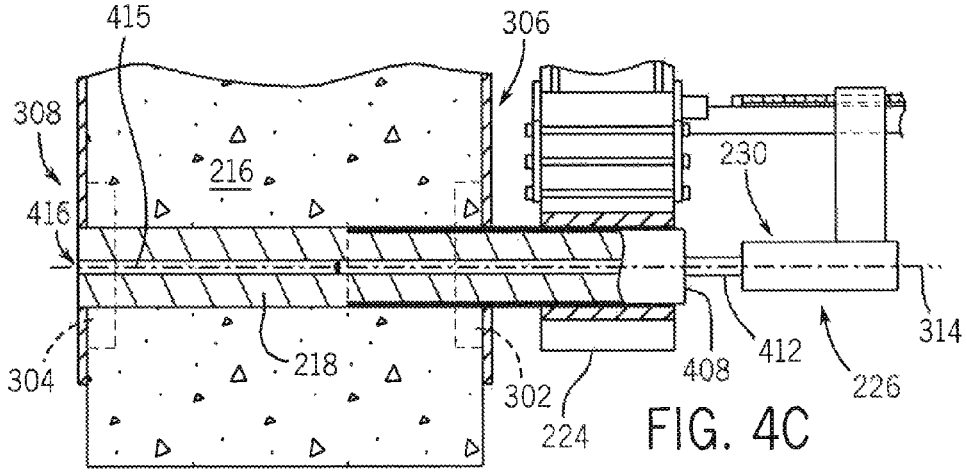
Figure 4D:
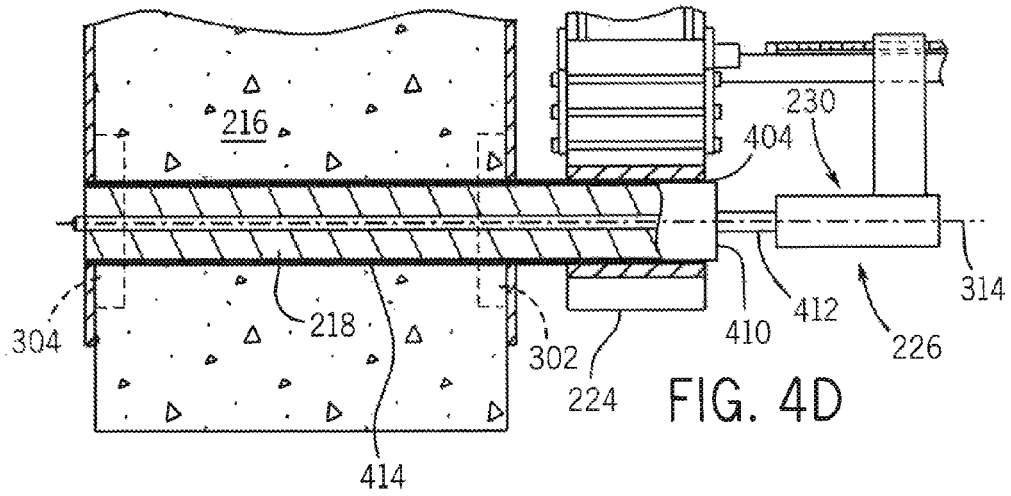

By comparison, while the drill bit 402 of FIGS. 4A and 4B is relatively short in axial length as measured along the central axis 314, successive second and third core drill bits 408 and 410 respectively shown in FIGS. 4C and 4D, respectively, have successively longer lengths as measured along the central axis 314. FIG. 4C particularly shows the second core drill bit 408 as having removed a larger portion of the core of the trunnion pin 218, and FIG. 4D further shows the third core drill bit 410 as having successfully completed the removal of the entire core of the trunnion pin 218 such that only a trunnion pin sleeve 414 remains within the trunnion box 216.

As already noted, although not shown in FIGS. 4A-4D, the roller bearings 251 can serve to stabilize each of the drill bits 402, 408 and 410 during the core drilling process when such roller bearings are present.

Thus, by virtue of this process employing the multiple ones of the drill bits 402, 408, 410, all of the core of the trunnion pin 218 can be successfully removed without requiring excessive axial movement of the core drill 230 used to rotate the drill bits. Depending upon the embodiment or circumstance, a variety of different types of core drill bits having a variety of different characteristics can be employed. For example, in relation to certain types of trunnion pins of hard steel, Tungsten Carbide drill bits can be appropriate, while Carbide or other types of drill bits can be appropriate for trunnion pins of softer steel. The numbers, spacing, and replacement of core drill bit teeth can vary depending upon the embodiment or circumstance as well.

As should be evident from the above discussion, alignment of the core drill 230 so that the central axes of the various drill bits are aligned with the central axis 314 of the trunnion pin 218 is typically of significance in terms of achieving desired core drilling. Depending upon the embodiment, such alignment can be achieved in various manners and, in at least some embodiments, such alignment can be accomplished by way of a laser bore sighter serving as a laser alignment tool. More particularly, in at least some such embodiments, and as discussed further with respect to FIG. 5B, prior to any core drilling (and/or possibly at some time or times during the drilling process, for example, when drilling has been temporarily stopped and the core drill has been retracted), a laser (not shown in FIGS. 3-4D) can be fit onto a shaft 412 (or in other embodiments, fit into a hole) on the core drill 230 on which drill bits such as the drill bits 402, 408, 410 are ultimately mounted. The laser is attached to the core drill 230 particularly when the core drill is positioned proximate the first side 306 of the trunnion box 216, and configured so that the laser output of the laser would be axially aligned with the center of the drill bits when the core drill is operational and the drill bits are mounted thereon.

Additionally, the trunnion pin 218 (prior to core drilling) already typically has a narrow internal channel 415 extending along and aligned with the central axis 314, as is particularly illustrated in FIGS. 4A-4C. Thus, it is additionally possible prior to the core drilling to place a laser target structure such as a card with a pin hole in it (not shown in FIGS. 3-4D) at a far end of the internal channel 415, at the second side 308 of the trunnion box 216. The laser affixed to the core drill 230 can then be actuated so as shine a laser beam through the trunnion pin 218, via the internal channel 415 from the first side 306 to the second side 308 of the trunnion box 216, and the position of the core drill 230 can be finely adjusted so that the laser beam is aligned with the target structure (e.g., the laser beam shines through the pin hole). Thus, use of the laser bore sighter allows for aligning of the core drill 230 so that the core drill (and the drill bits 402, 408, 410 ultimately driven by the core drill during the core drilling process, with which the laser is replaced during the core drilling process) is aligned with the central axis 314 of the trunnion pin 218.

It should further be appreciated that, during the core drilling process as shown in FIGS. 4A-4D, water typically is directed into and toward the trunnion pin 218 from the core drill 230 and particularly the drill bit(s), to allow for cooling and also to flush out shavings/drilled-out material. Due to the presence of the internal channel 415 within the trunnion pin 218, at least some of the flushing water would tend to proceed through and out the channel at or proximate the second side 308 of the trunnion box 216 without some measure being taken to address this issue. Yet this is undesirable from the standpoint of performing an efficient and cleanly core drilling process. Therefore, as discussed further with respect to FIG. 5B, to redirect the flushed water and other material therewithin so that all (or substantially all) of that water/material exits the system by way of the first side 306 of the trunnion box 216, the internal channel 415 can in at least some embodiments be plugged at or proximate to the second side 308 of the trunnion box, e.g., at an end location 416 of the channel shown in FIGS. 4A-4C. The plugging of the internal channel 415 can be accomplished, for example, by way of a standard water stop plug being positioned into the internal channel at or proximate to the end location 416.

Methods of Removal of Trunnion Pin Sleeve

Figure 5A:
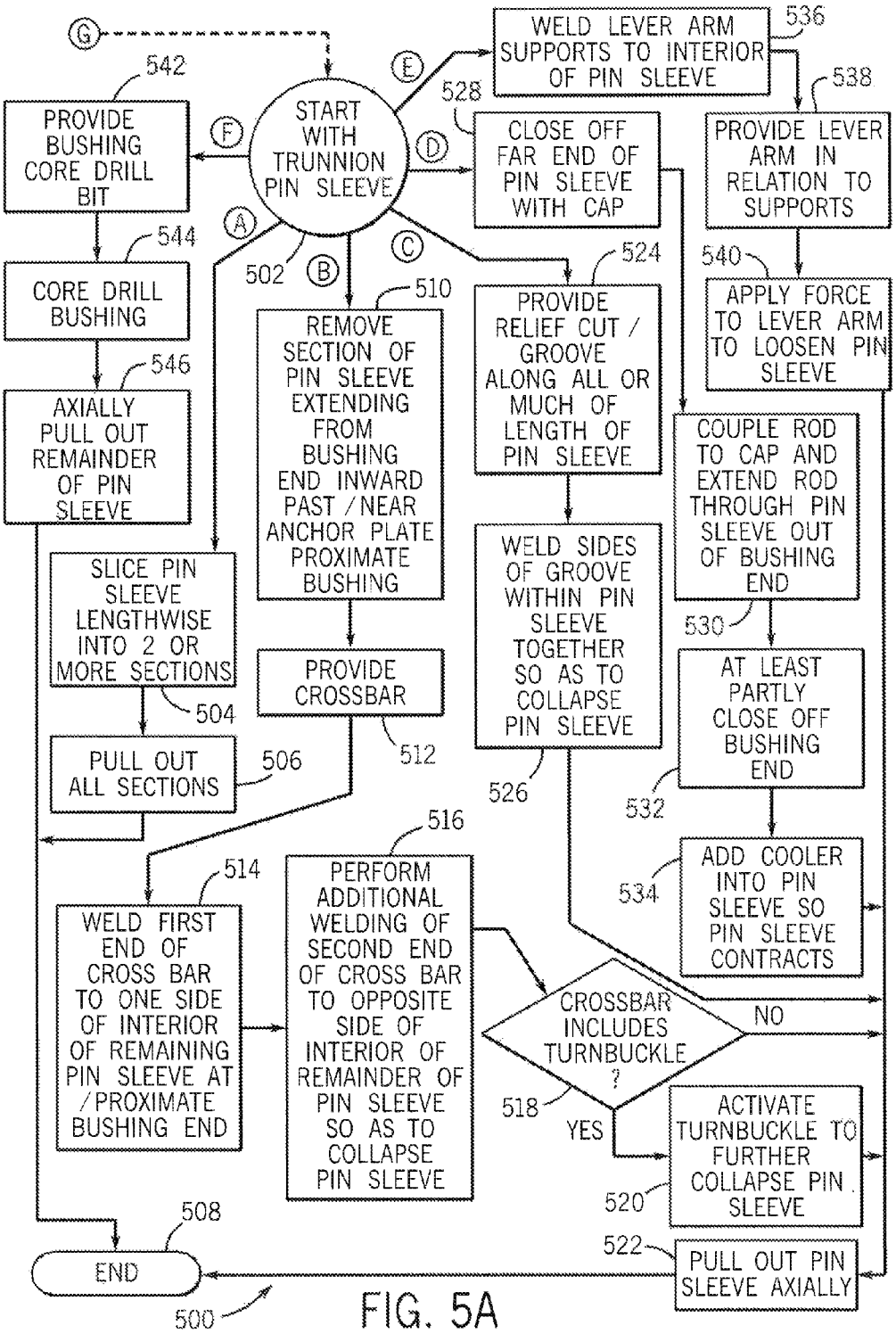
FIG. 5A is a flow chart showing example steps of multiple trunnion pin sleeve removal processes A-F that can be performed in order to remove a trunnion pin sleeve that remains after the trunnion pin of FIGS. 2A-4D has been core-drilled to remove a core.

As mentioned above, once the core drilling process is completed and all that remains of the trunnion pin 218 is the trunnion pin sleeve 414, the trunnion pin sleeve must then be removed from the trunnion box 216 and from the tainter gate 104. Turning to FIG. 5A, example steps of six different example processes A-F for removing the trunnion pin sleeve 414 are shown in a flow chart 500. As also described in further detail below, additional FIGS. 6-11 illustrate schematically how one or more of these steps of FIG. 5A are performed in relation to the trunnion pin sleeve 414. More particularly as shown in FIG. 5A, each of the processes A-F shown begin at a start step 502 at which it is presumed that the trunnion pin sleeve 414 is present (that is, the processes start subsequent to completion of the core drilling process discussed with respect to FIGS. 4A-4D).

Figure 6:
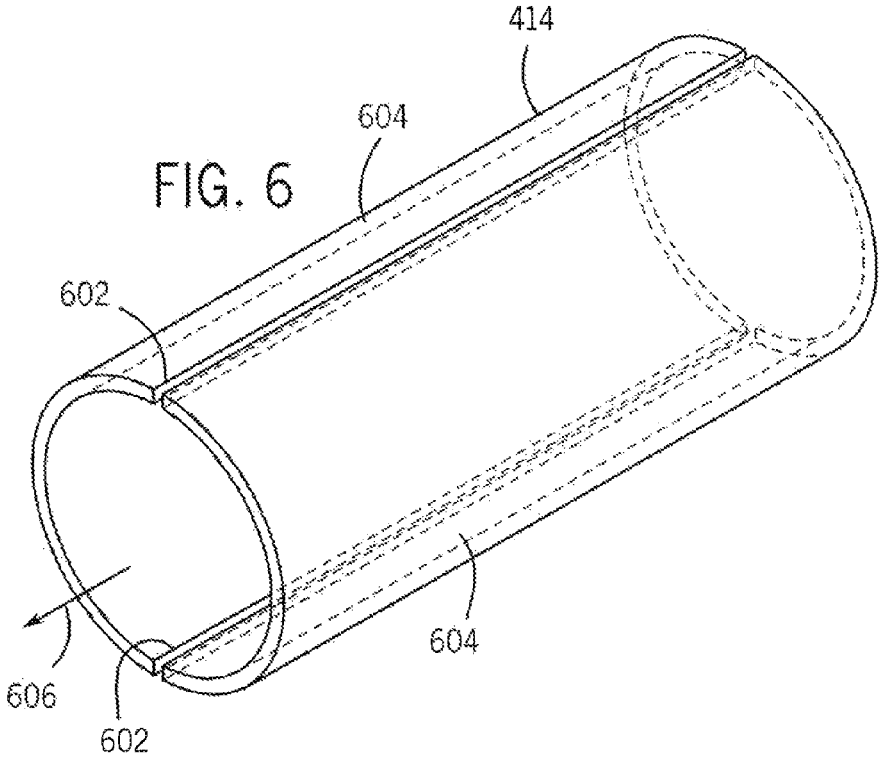
FIG. 6 is a schematic illustration of the trunnion pin sleeve removal process A shown in FIG. 5A.

Upon beginning at the step 502, the first process A is shown to proceed with a step 504 at which the trunnion pin sleeve (or simply pin sleeve) 414 is sliced lengthwise into two or more sections. FIG. 6 in this regard shows the trunnion pin sleeve 414 and additionally shows two example cuts 602 to have been made along the entire length of the pin sleeve 414. In the present example, the two cuts 602 are both axially parallel to the central axis of the pin sleeve (which is the same as the central axis 314 of the trunnion pin 218 shown in FIGS. 3-4D) and positioned diametrically opposed from one another, such that upon the cutting being completed the pin sleeve is divided into two semi-cylindrical portions 604. The cutting can be performed manually or automatically (typically manually) by way of any of a variety of cutting tools, provided, however, that it is important that the cutting operation be carefully performed such that the cutting tool does not protrude outward beyond the exterior surface of the pin sleeve lest the cutting tool significantly cut or damage the anchor plates 302, 304 or any other portion of the trunnion box 216 (see FIG. 3), and/or the trunnion bushing 220 in cases where the trunnion bushing is not also being replaced along with the trunnion pin replacement.

Although FIG. 6 shows the pin sleeve 414 as being divided into two semi-circular portions, in other embodiments more than two cuts can be provided such that the pin sleeve is divided into more than two portions. Further, depending upon the embodiment, the portions into which the pin sleeve 414 is cut need not be cylindrical or identical in shape. Regardless of the number of sections, or shapes of the sections, into which the pin sleeve 414 is cut at the step 504, upon completion of the cutting, the process A shown in FIG. 5A then proceeds from the step 504 to a step 506, at which all of the sections 506 of the trunnion pin sleeve 414 are pulled out or otherwise removed from the trunnion box 216 and tainter gate 104. This step is represented by an arrow 606 in FIG. 6. Upon performing of the step 506, the process then is complete and ends at an end step 508.

Figure 7A:
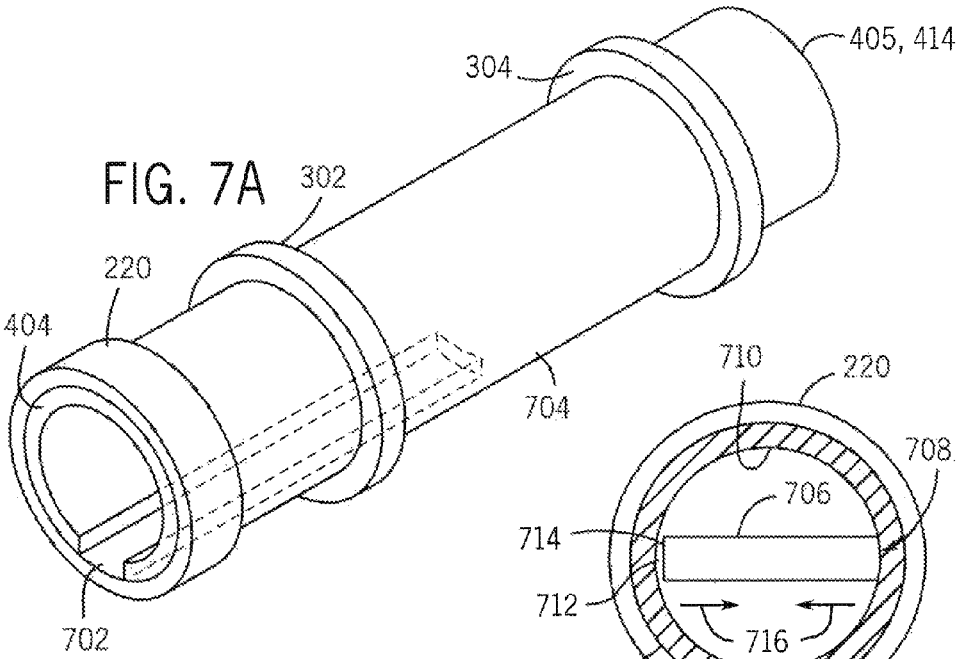
FIGS. 7A-7D respectively are four schematic illustrations of different steps of the trunnion pin sleeve removal process B shown in FIG. 5A.

Further referring to FIG. 5A, a second process B for removing the pin sleeve 414 upon beginning with the step 502 proceeds with a step 510, in which a section of the pin sleeve extending from a first end 404 of the pin sleeve proximate the trunnion bushing 220 inward past (or near) the first anchor plate 302 is cut away and removed, leaving a cutout. In relation to this step, FIG. 7A shows the trunnion pin sleeve 414 along with the first and second anchor plates 302 and 304 and the trunnion bushing 220 and further shows a cutout 702 of the pin sleeve 414 to have been removed from a remainder 704 of the pin sleeve. Further as shown, the cutout 702 extends from the first (bushing) end 404 of the pin sleeve 414 inward to a location just inwardly past the first anchor plate 302, the first end 404 being opposite a second end 405 of the pin sleeve that is located proximate the second anchor plate 304. The removal of the section of the pin sleeve 414 resulting in the cutout 702 can be performed by way of a cutting operation employing a cutting tool (or multiple cutting tools) such as the one(s) used to perform the step 504. However, in at least some circumstances the cutting need not be performed with as much care as in the step 504 since it is not of great concern whether the trunnion bushing 220 is damaged during this process (albeit care must still be exercised not to damage the first and second anchor plates 302, 304). Alternatively, in some other circumstances care must still be exercised to avoid damage to the trunnion bushing 220 if the trunnion bushing is not being replaced (or if a trunnion bushing does not exist and the trunnion pin is in direct contact with the trunnion casting).

Figure 7B:
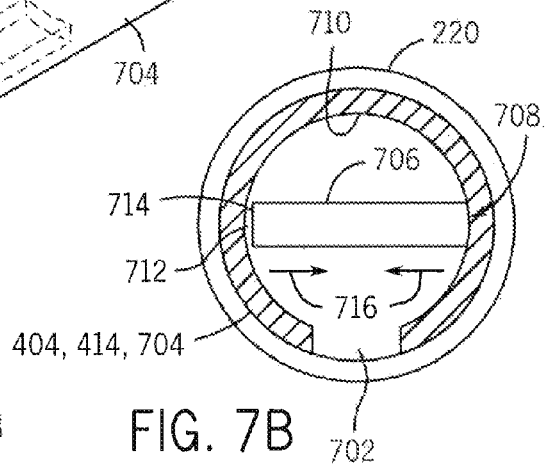

Following removal of the section resulting in the cutout 702, the process advances from the step 510 of FIG. 5A successively to steps 512 and 514. As illustrated further by FIG. 7B, in the step 512 a cross bar 706 is provided for use in relation to the removal of the remainder 704 of the pin sleeve 414, and in the step 514 a first end 708 of the cross bar is welded to one side of an interior surface 710 of the remainder of the pin sleeve near or proximate to the first (bushing) end 404. FIG. 7B particularly makes it clear that the cross bar 706 has a length that is slightly shorter in length than an inner diameter of the interior surface 710 of the pin sleeve 414. Consequently as shown, upon the welding of the first end 708 of the cross bar 706 to the interior surface 710, there is remaining a space 712 between a second end 714 of the cross bar and the interior surface 710 of the pin sleeve 414.

Further referring to FIG. 5A, subsequent to the performing of the step 514, the process B advances next to a step 516 in which additional welding is performed so as to weld together the second end 714 of the cross bar 706 with the interior surface 710 of the remainder 704 of the pin sleeve 414 (in particular to the opposite side of that interior surface relative to the location at which the first end 708 was welded at the step 514). Due to this welding operation, the remainder 704 of the pin sleeve 414 naturally is drawn toward the second end 714 of the cross bar 706 such that the remainder of the pin sleeve is slightly constricted or collapsed radially-inwardly toward (or generally toward) the central axis 314 (as shown in FIGS. 3-4D) of the pin sleeve, at least at regions of the remainder of the pin sleeve that are axially-positioned (again along the central axis) relatively close to the first end 404 of the pin sleeve. This collapsing of the pin sleeve 414 inward is represented by arrows 716 shown in FIG. 7B.

Figure 7C:
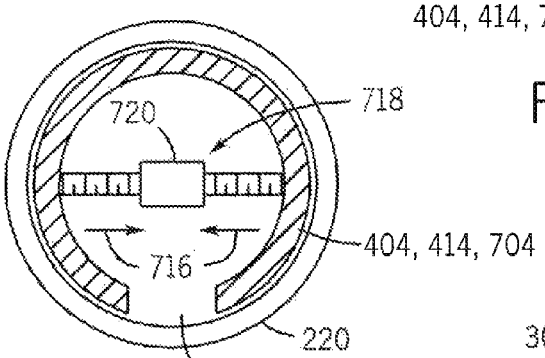
Figure 7D:
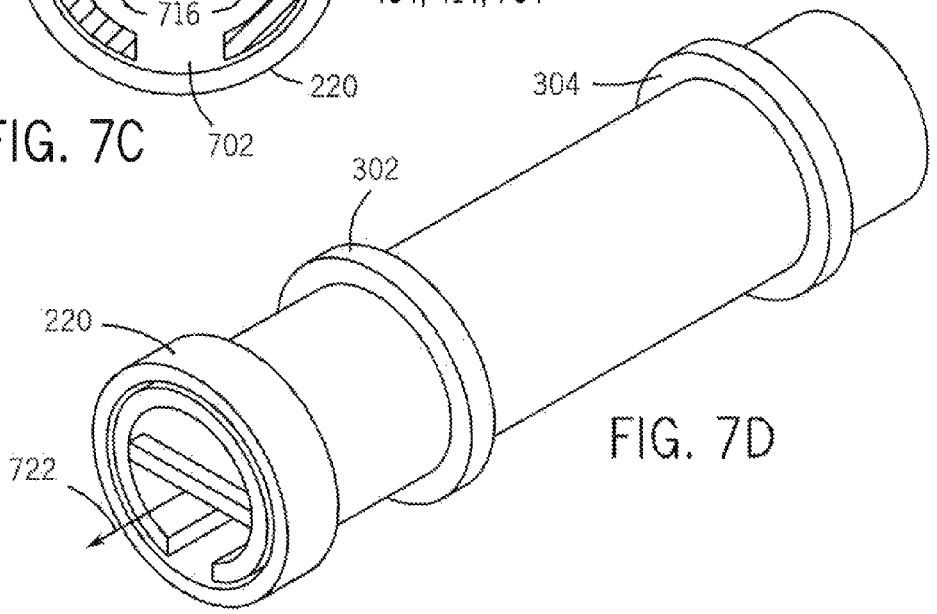

Although FIG. 7B suggests that the collapsing of the pin sleeve 414 (or the remainder 704 thereof) occurs entirely due to the welding of the second end 714 in relation to the pin sleeve, this need not be the case in every embodiment. As illustrated by FIG. 7C, in at least some embodiments, a modified version of the cross bar 706 shown as a cross bar 718 can instead be employed that includes a turnbuckle 720 in between the two ends of the cross bar. When a device such as the turnbuckle 720 is employed, the collapsing of the pin sleeve 414 can occur both because of the welding operation at the step 516 as well as subsequent to such a welding step upon operation (e.g., rotation) of the turnbuckle that further draws the two ends of the cross bar 718 toward one another. FIG. 5A envisions this possibility by including a block (or step) 518 subsequent to the step 516 at which it can be taken into account whether the cross bar includes a turnbuckle or not. In the event a turnbuckle is present, the process advances from the block 518 to a step 520 at which the turnbuckle 720 is actuated to further collapse the pin sleeve 414.

Further as shown in FIG. 5A, both in the event that the cross bar 706 not having any turnbuckle is present as determined at the step 518 (such that the collapsing of the remainder 704 of the pin sleeve 414 only occurs as a result of the welding of step 516), or in the event that the collapsing is accomplished due to that welding and additionally via actuation of the turnbuckle 720 as represented by the step 520, in either case the process advances to the step 522. At the step 522, the collapsed pin sleeve (or more particularly the collapsed remainder portion 704 of the pin sleeve 414) is pulled out from the anchor plates 302, 304 and the trunnion box 216 as well as out of the trunnion bushing 220, as represented by an arrow 722 shown in FIG. 7D.

It should be appreciated from the process B that the removal of the section of the pin sleeve 414 resulting in the cutout 702 facilitates the collapsing of the remainder 704 of the pin sleeve 414 as occurs at one or both of the steps 516 and 520, and further that the collapsing of the remainder 704 substantially enhances the ease with which the pin sleeve 414 (or remainder 704 thereof) can be removed from the trunnion box 216 (including the anchor plates 302, 304) and the trunnion bushing 220. Indeed, due to the removal of the section resulting in the cutout 702 of the pin sleeve 414 and the collapsing of the remainder 704, the remainder is substantially dislodged from the anchor plates 302, 304 and the trunnion bushing 220 to such an extent that any corrosion or other considerations that might previously have precluded or limited removal of the pin sleeve 414 are much more easily overcome.

Notwithstanding the above description concerning the process B, variations of this process are also possible and intended to be encompassed herein. For example, it should be noted that in some embodiments the collapsing of the remainder 704 of the pin sleeve 414 entirely (or only predominantly) occurs due to the actuation of the turnbuckle 720, and the welding of the two ends of the cross bar 718 itself does not actually result in any significant amount of collapsing of the remainder of the pin sleeve. Also, in some circumstances, the turnbuckle 720 is only actuated at times when the collapsing due to the welding at the step 516 was insufficient to allow for easy removal of the remainder 704 of the pin sleeve 414. Further, in at least some other embodiments, other devices or components can be used as part of a cross bar to achieve the same contraction of the length of the cross bar so as to produce collapsing of the remainder 704 of the pin sleeve 414. Also, in at least some other embodiments, it is possible that a section of the pin sleeve 414 need not be removed (so as to form a cutout) but rather that a desired amount of collapsing can be achieved simply through the use of a cross bar. Further, in at least some other embodiments, more than one cross bar or similar device can be used concurrently (e.g., two cross bars could be provided, oriented at right angles or other angles relative to one another).

Still referring to FIG. 5A, still an additional process C is also shown by which removal of the pin sleeve 414 is facilitated. The process C, after starting at the step 502 proceeds to a step 524 at which a relief cut or groove is provided along all or much of the length of the pin sleeve 414. FIG. 8A again shows the pin sleeve 414 along with the first and second anchor plates 302, 304 and the trunnion bushing 220, and additionally in this case shows an example relief groove 800 extending the entire length of the trunnion pin sleeve 414. The relief groove 800 in the present example is parallel to the central axis 314 of the pin sleeve 414 (as shown in FIGS. 3-4D), although it could take another form. The relief groove 800 can be cut manually or automatically using the same type of tool or tools discussed above with respect to the slicing of the pin sleeve in the step 504 and/or the creation of the cutout 702, and care must be exercised that the providing of the relief groove does not damage or significantly damage the trunnion box 216 and the anchor plates 302, 304 associated therewith (also, if the trunnion bushing 220 is not being replaced, care must be exercised not to damage that bushing as well). Nevertheless, since only the single relief groove 800 is created at the step 524, as opposed to two or more cuts as described with respect to the step 504, the performing of the step 524 is considerably less involved than the performing of the step 504.

Figure 8A:
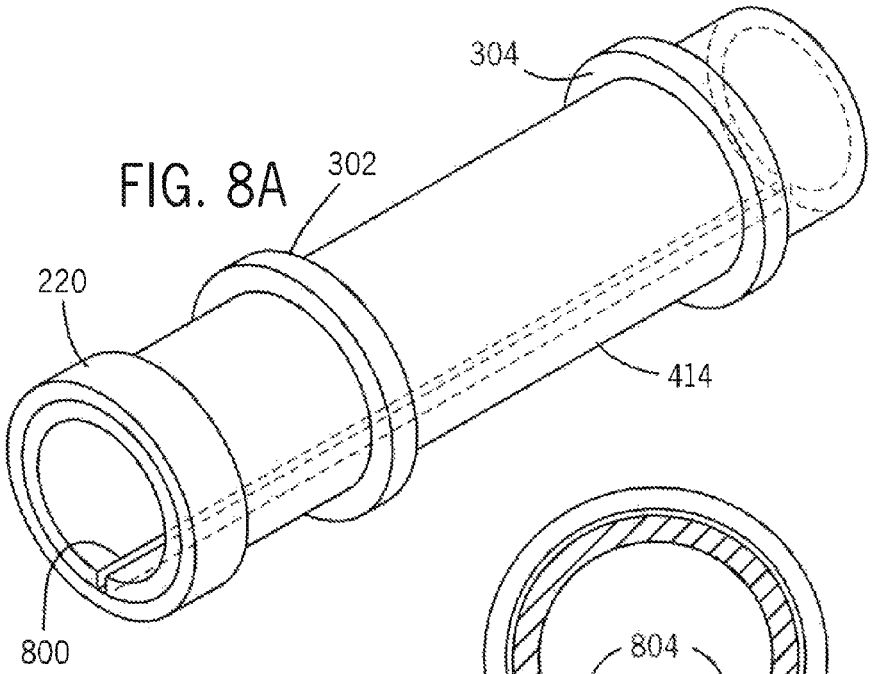
FIGS. 8A-8C respectively are three schematic illustrations of different steps of the trunnion pin sleeve removal process C shown in FIG. 5A.
Figure 8B:
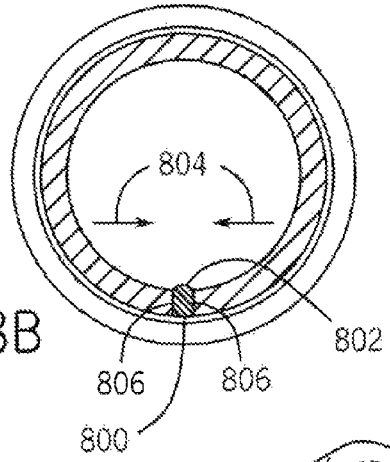
Figure 8C:
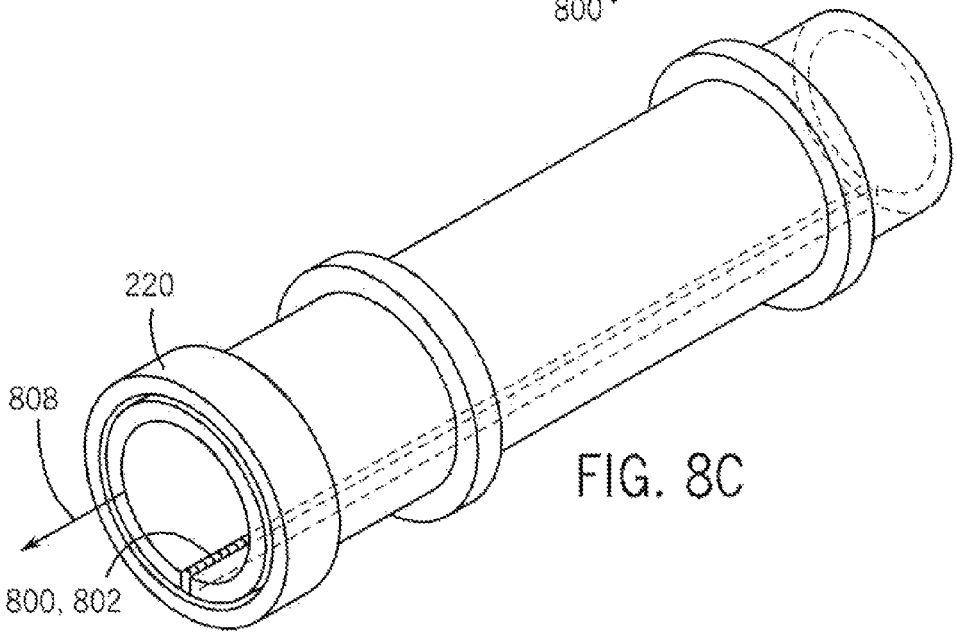

Still referring to FIG. 5A, upon completion of the relief groove 800 at the step 524, then at a step 526 welding is performed within the grove so that the sides of the groove are welded together. This step is further illustrated at the FIG. 8B, which shows a weld 802 of sides 806 of the relief groove 800. Similar to how the welding process discussed with respect to the step 516 caused collapsing of the remainder 704 of the pin sleeve 414, as represented in FIG. 8B by arrows 804, the welding operation of the step 526 causes the side surfaces 806 of the pin sleeve 414 exposed due to the relief cut 800 to be brought together and this in turn causes constriction or collapsing of the pin sleeve radially inward, thus reducing the overall diameter of the pin sleeve (during the welding, it is important that the welding does not result in adhering of the pin sleeve 414 to the anchor plates 302, 304, trunnion bushing 220, or trunnion casting 224 or damage to the anchor plates/trunnion bushing/trunnion casting). Due to this collapsing, following the performing of the step 526, the process C again proceeds to the step 522 at which the pin sleeve 414 is axially pulled out of the anchor plates 302, 304/trunnion box 216 and the bushing 220. This pulling out of the pin sleeve 414 is represented by an arrow 808 shown in FIG. 8C, which also shows the weld 802 of the relief cut 800.

Yet a fourth process D for removal of the pin sleeve 414 is also shown in FIG. 5A. The process D, upon beginning at the step 502, advances to a step 528, at which the second end 405 of the pin sleeve 414 is closed off with a cap (wall). Upon the closing off of the second end 405 of the pin sleeve 414 with the cap, the process then further advances from the step 528 to a step 530, at which a rod is coupled to the cap so as to extend through the pin sleeve 414 from the second end 405 and to and out the first end 404 (the bushing end of the pin sleeve). Further as shown in FIG. 5A, following the step 530, an additional barrier is provided at the first (bushing) end 404 of the pin sleeve 414 that at least partly closes off that end as well, at a step 532. Although the step 532 is shown to follow the step 530 in FIG. 5A, it should be understood that in other embodiments the actions associated with those steps can be performed simultaneously or substantially simultaneously and/or possibly the step 532 action can precede the step 530 action.

Figure 9A:
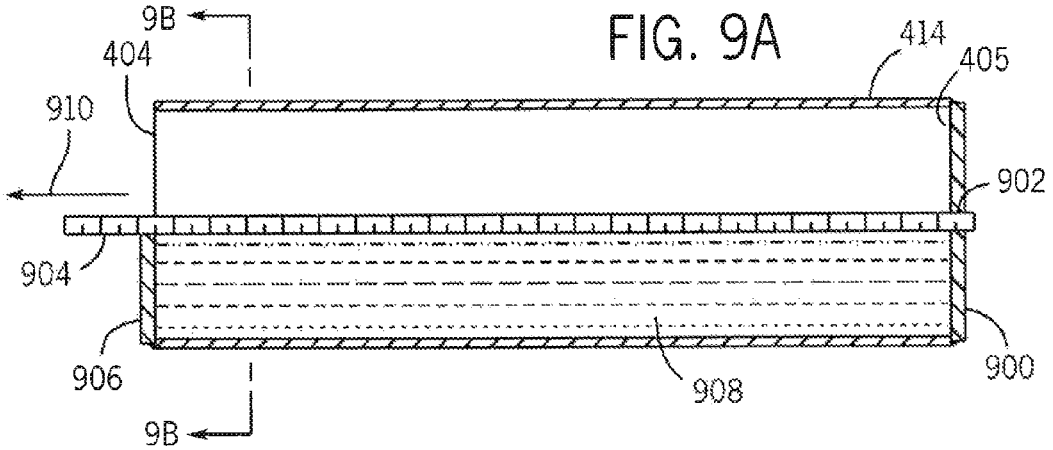
FIGS. 9A-9B respectively are two schematic illustrations of different steps of the trunnion pin sleeve removal process D shown in FIG. 5A.

The results of the steps 528, 530, 532 are additionally illustrated in FIG. 9A, which shows a side cross-sectional view of the pin sleeve 414 (taken along the central axis 314 of FIGS. 3-4D) with the first and second ends 404 and 405, respectively. More particularly as shown, the pin sleeve 414 is supplemented with a cap 900 being affixed at that second end 405 in a manner that the entire end is sealed off except for a hole 902 provided through the cap 900 at the center of the cap (that is, surrounding the central axis of the pin sleeve). Additionally, a rod 904 is shown to be positioned through the hole 902 of the cap 900 and to extend from the cap at the second end 405 of the pin sleeve 414 through the pin sleeve and out the front (bushing) end 404 (typically, the rod 904 is inserted from the first end 404 to the second end 405 and then secured to the cap 900, but a reverse insertion process is also possible depending upon accessibility). The rod 904 is shown to extend somewhat beyond the first end 404 for easy attachment or grasping, as will be discussed further below. In the present embodiment, the rod 904 is threaded and particularly is attached to the cap 900 by threading the rod through the hole 902 so as to be attached to the cap due to the complimentary threads of the rod and interior surface forming the hole 902, although other arrangements by which a rod is attached to a cap are also possible (e.g., in another embodiment the cap does not have a hole all of the way through the cap but merely a recess into which the rod can be screwed).

Figure 9B:
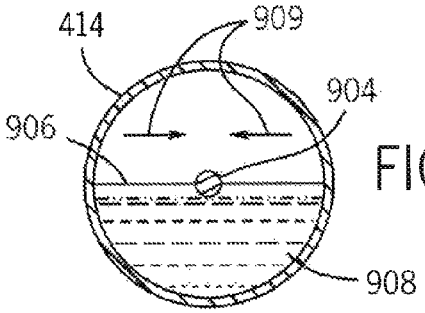

Further as shown in FIG. 9A and additionally in FIG. 9B, the partial closing off of the first end 404 is shown to be performed by a barrier 906 that is a substantially semi-circular cap portion positioned along the bottom half of the first end 404. It will be understood, in the embodiment shown in FIG. 9B, that the barrier 906 includes a dimple for receiving the rod 904 so that the rod can pass by (through) the barrier while still following a path that is along the central axis 314 of the pin sleeve 414 (again see FIGS. 3-4D for the central axis 314). The cap 900 and barrier 906 can be affixed to the second and first ends 405 and 404, respectively, in any variety of manners depending upon the embodiment, including by way of welding, various types of adhesives (e.g., glues), or other fastening mechanisms or processes. Also, while the barrier 906 takes a substantially semi-circular form as shown in FIG. 9B, in other embodiments it can take other forms (for example, it could occupy greater than a 180 degree sector).

Subsequent to the step 532, the process D next involves performance of a step 534, at which a cooler or cooling substance (or coolant) 908 as also shown in FIGS. 9A-9B is added into the pin sleeve 414. Example coolers that can be used include liquid nitrogen or dry ice (frozen carbon dioxide). Due to the introduction of the cooler 908, the pin sleeve 414 contracts (collapses) as represented by arrows 909 in FIG. 9B. Due to such contraction, the process D again proceeds to the step 522, in which the pin sleeve 414 is axially pulled out from the trunnion box 216 and associated anchor plates 302, 304, as well as out of the trunnion bushing 220. In this embodiment, the pulling out of the pin sleeve 414 is particularly performed by applying a pulling force upon the rod 904 in the direction indicated by an arrow 910 shown in FIG. 9A (which is parallel to, or substantially parallel to, the central axis 314 of the pin sleeve). Because the rod 904 is coupled securely to the cap 900, and because the cap 900 is securely coupled to the second end 405 of the pin sleeve 414, force applied to the rod 904 removes the entire combination of the cap 900, the pin sleeve 414, the barrier 906, and the rod 904 itself.

It should be noted with respect to the processes B, C, and D that, although the collapsing/contraction of the pin sleeve 414 (or remainder thereof) resulting from the welding, turnbuckle actuation, or cooling/coolant effects performed during these processes is often sufficient for allowing removal of the pin sleeve 414 (or remainder thereof) at the step 522 by way of application of a pulling force, in at least some embodiments this collapsing/contraction is not fully sufficient to adequately dislodge the pin sleeve from the trunnion box 216/anchor plates 302,304/trunnion bushing 220. That said, in such cases, further dislodgement allowing for removal via pulling at the step 522 can potentially be achieved by applying an additional torquing action upon the pin sleeve 414 (or remainder thereof) prior to the step 522. Such a torquing action can be applied, in the case of the process B, to the cross bar 706 or 718. Also, in the case of the process D, this can be achieved by applying a twisting force to the rod 904 that is then communicated to the cap 900 and/or the barrier 906. As for the case of the process C, a torquing action can be achieved either by applying a force directly to the pin sleeve 414 or by adding a cross bar to the pin sleeve and applying such a force to the cross bar.

Figure 10:
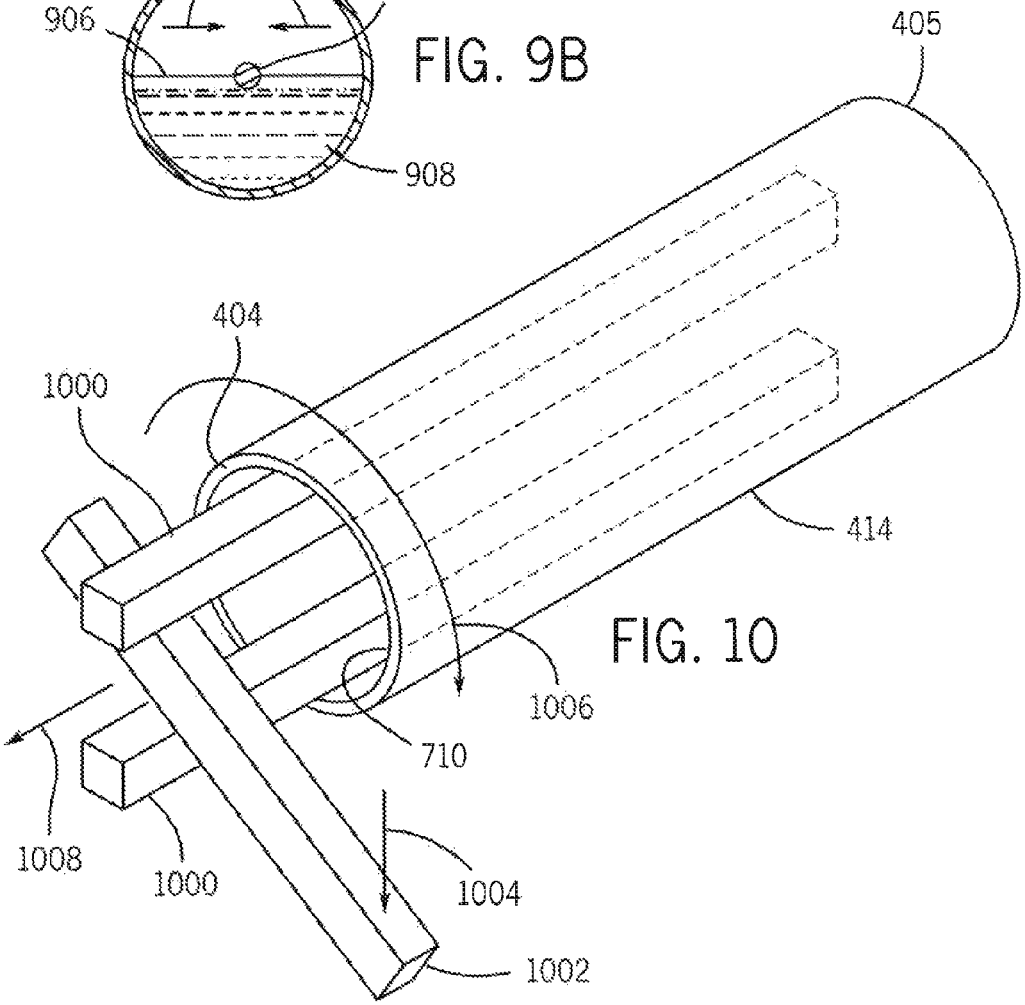
FIG. 10 is a schematic illustration of the trunnion pin sleeve removal process E shown in FIG. 5A.

In addition to the aforementioned processes A-D, FIG. 5A shows still an additional process E for removal of the pin sleeve 414 as well, which begins following the start step 502 at a step 536 in which two (or possibly more) lever arm supports are welded to the interior surface of the pin sleeve 414. Referring additionally to FIG. 10 in this regard, first and second lever arm supports 1000 particularly are shown to be coupled (welded) to the interior surface 710 of the pin sleeve 414 in this manner. It will be noted that the lever arm supports 1000 extend entirely or largely entirely the entire length of the pin sleeve 414 between the first and second ends 404, 405 and also extend outward from the inside of the pin sleeve beyond the first end by a certain distance so as to allow for a lever arm 1002 to be connected to those lever arm supports. Further in this regard, FIG. 5A shows the process E to further include, following the step 536, a step 538 in which the lever arm 1002 is provided in relation to the lever arm supports 1000. It will be appreciated that (to achieve operation as discussed below) the lever arm 1002 particularly should be situated with respect to the lever arm supports 1000 so that the application of force upon the lever arm causes one of the lever arm supports to be pressured in one translational direction while the other lever arm support receives pressure in the opposite translational direction.

Subsequent to the step 538, at a step 540 shown in FIG. 5A, the process E further involves application of a force 1004 to the lever arm 1002 as shown in FIG. 10. Due to the particular manner in which the lever arm 1002 is situated relative to the lever arm supports 1000, the application of the force 1004 creates a torque upon the lever arm supports 1000 collectively, as represented by an arrow 1006. This torque is communicated to the pin sleeve 414, and in turn causes loosening of the pin sleeve. Therefore, following the performing of the step 540, it is possible again to proceed to the step 522, at which the pin sleeve 414 is pulled out axially from the trunnion box 216 and associated anchor plates 302, 304 as well as from the trunnion bushing 220, as is represented in FIG. 10 by an arrow 1008. As is the case with respect to all of the above-discussed processes B-D in which the step 522 is performed, following the step 522 the process E concludes at the end step 508.

As already discussed above, the processes B-D can in some other embodiments be supplemented with a torquing step. Although not mentioned above, such a torquing step can potentially be achieved by supplementing those processes (e.g., prior to the step 522) with the steps of the process E. Further, in at least some alternate embodiments, the steps of the process E can be supplemented with one or more of the steps of the processes B-D, including one or more of the steps that result in collapsing/contraction of the pin sleeve 414 (or remainder thereof). Further, notwithstanding the particular description of the process E shown in FIGS. 5A and 10, it should further be understood that, in at least some additional embodiments, more than two lever arm supports can be provided and/or more than one lever arm can be provided (for example, three or four lever arm supports can be provided allowing for lever arms to be attached and actuated from a variety of angles).

Figure 11:
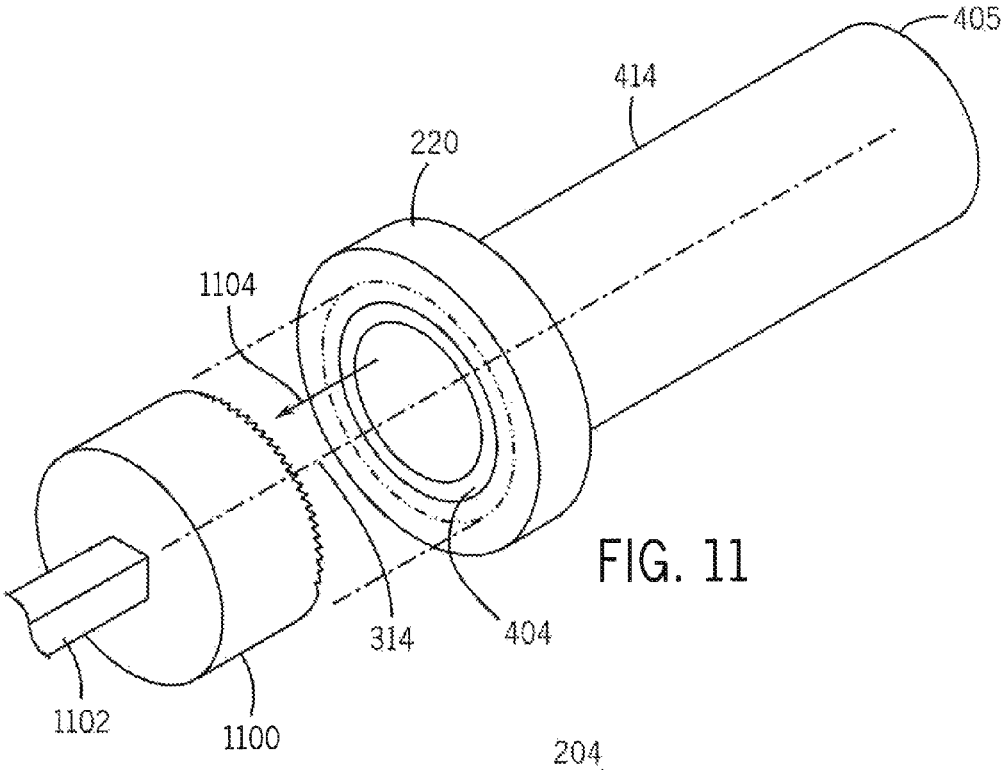
FIG. 11 is a schematic illustration of the trunnion pin sleeve removal process F shown in FIG. 5A.

Still referring to FIG. 5A, a sixth process F for removing the pin sleeve 414 is additionally shown as including, following the start step 502, a step 542 at which a bushing core drill bit is provided and aligned with the first end 404 of the pin sleeve 414 in a coaxial manner. That is, at the step 542, both the trunnion pin sleeve 414 and the drill bit, shown as a core drill bit 1100 in FIG. 11, are coaxially aligned with the central axis 314 of the pin sleeve. The drill bit 1100 provided at the step 542 is a core drill bit of a type similar to the drill bits 402, 408, 410 of FIGS. 4A-4D which were used to core drill the trunnion pin 218 so as to arrive at the pin sleeve 414 (in terms of materials composition, etc.) but with appropriate modifications as appropriate for cutting into the trunnion bushing material (e.g., appropriate cutting teeth). Also, the same core drill 230, support assembly 228, and other components of the core drill assembly 226 can be used to support and operate (rotate) the drill bit 1100 as were already discussed with respect to FIGS. 2B, 3 and 12, albeit for simplicity of description FIG. 11 only shows the drill bit 1100 and a link 1102 (shown in cut away) by which the drill bit is coupled to the core drill 230.

In contrast to the drill bits 402, 408, 410 used to core drill the trunnion pin 218, however, the drill bit 1100 has a diameter that is greater than the outer diameter of the pin sleeve 414 and instead has a diameter that is between the inner and outer diameters of the trunnion pin bushing 220. Given such a sizing, once the drill bit 1100 is set in place on the core drill 230 alongside the pin sleeve 414 and trunnion bushing 220, then at a step 544 of FIG. 5A the trunnion bushing is core drilled by way of that drill bit as actuated by the core drill. Often, the drill bit 1100 will have the shape of a hollow cylinder (with teeth located at one end of the cylinder), where the inner diameter of the cylinder exceeds the outer diameter of the pin sleeve 414 such that the pin sleeve is not at all affected by the drilling of the trunnion bushing 220. Alternatively, the drill bit 1100 can be a solid cylinder or a hollow cylinder having an inner diameter that is less than the outer diameter of the pin sleeve 414. In such cases, as the trunnion bushing 220 is core drilled axially along the central axis 314, portion(s) of the pin sleeve 414 coinciding axially with the trunnion bushing can also drilled away (in some such cases, the pin sleeve 414 will be reduced in axial extent, while in other such cases the pin sleeve outer diameter will be reduced over a portion of the axial extent of the pin sleeve).

As a result of this core drilling process, the pin sleeve 414 (or remainder thereof) is completely decoupled from the tainter gate 104/casting 224. Consequently, the pin sleeve 414 (or remainder thereof) can be more easily pulled out axially at a step 546 of FIG. 5A and as represented by an arrow 1104 in FIG. 11, since only resistance from the anchor plates 302, 304/trunnion box 216 may remain to restrict removal. At the same time, if remaining resistance from the anchor plates 302, 304/trunnion box 216 still is sufficient to preclude removal of the remainder of the pin sleeve 414, then additional steps or processes of removal (including one or more of the steps of processes A-E discussed above) can be employed following the process F.

The above-described processes and process steps associated with removal of a trunnion pin sleeve such as the pin sleeve 414 following core drilling of a trunnion pin such as the trunnion pin 218 are only intended to be examples, and it is envisioned that additional variations of these processes and process steps are also encompassed herein. Among other things, portions of these processes (e.g., one or more individual steps) can be rearranged in order, combined, and/or eliminated in a variety of manners other than as discussed above. For example, in some other embodiments or circumstances, portions of one of the example processes can be performed in addition with portions of another (or others) of the example processes. Further for example in this regard, the application of a torquing force via the lever arm and lever arm supports can be performed following the performing of a compression (or constriction) operation involving welding and/or cooling. Also for example in this regard, compression steps of the processes B, C, or D or the torquing force application steps of the process E can be performed in relation to the portion of the pin sleeve remaining after the trunnion bushing is core drilled in the process F. Additionally for example, the slicing of the pin sleeve into multiple sections in the process A can be performed following some of the steps of one or more of the other processes B, C, D, E, or F.

Figure 5B:
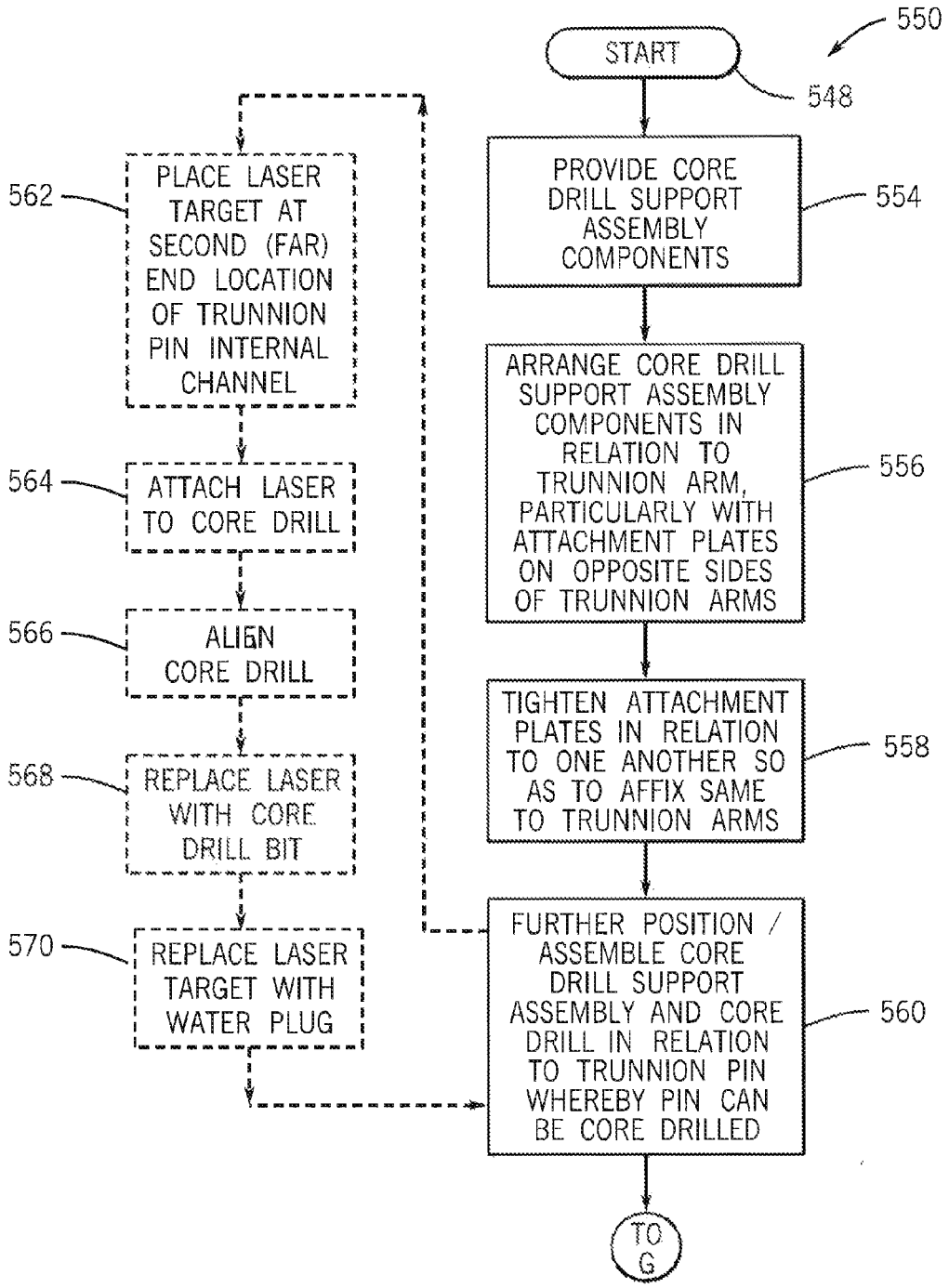
FIG. 5B is a flow chart showing example steps of a process for assembling a core drilling platform that supports a core drill used to remove the core of the trunnion pin and leave the trunnion pin sleeve referred to in FIG. 4A.

Further, referring to FIG. 5B, the processes A-F (or other variations of those processes) can additionally be supplemented with an additional process represented by a flow chart 550 by which the core drill assembly 228 of FIGS. 2B and 3 is set up/provided in relation to the trunnion pin 218. The flow chart 550 is particularly shown to include steps that are performed prior to a point G of FIG. 5A, at which it is assumed that core drilling takes place such that step 502 begins with provision of the trunnion pin sleeve 414.

Referring thus to FIG. 5B, upon commencing with a start step 548 the flow chart 550 advances to a step 554, at which components of the support assembly 228 (as shown in FIGS. 2B, 3, and 12) are provided. Next, at a step 556, the support assembly 228 components are arranged in relation to the trunnion arms 204. More particularly, in the present embodiment, one of the attachment plates 1204 is positioned on one side of the pair of trunnion arms 208, 210 while the other of the attachment plates is positioned on the other side of the pair of trunnion arms 208, 210. Then, at a step 558, the two attachment plates 1204 are tightened relative to one another by way of the coupling bolts 1206 so that the respective plates are in contact with the respective opposite sides of the pair of trunnion arms 208, 210. In this manner, the combination of the two attachment plates 1204 is tightly fastened abut the pair of trunnion arms 208, 210 as shown particularly in FIGS. 2B and 3.

Finally, following the step 558, at a step 560 of the flow chart 550, the support assembly 228 and core drill 230 components are further positioned in relation to the trunnion pin 218 so as to allow for core drilling. In this regard, the step 560 can include not only the affixing of the support arm 229 onto the already-positioned components of the support assembly 228 (e.g., in relation the attachment plates 104 or at least one of those plates such as the outer attachment plate 246), and related setting up of additional supports such as the support bracket 241 and lateral stabilizers 243, 245, but also the affixing of the core drill 230 in relation to that support arm, which particularly can include assembling the extension arm 1208 of the core drill to the support arm. As shown in FIGS. 3 and 12, the extension arm 1208 serves both to couple the core drill 230 (which is positioned along the central axis 314) with the support arm 229 adjacent thereto, but also to facilitate the sliding (translational) movement of the core drill 230 relative to the support arm 229. Attachment of a core drill bit to the core drill 230 can also be considered part of the step 560, if the core drill does not come automatically equipped with a particular drill bit.

As illustrated by further sub steps 562, 564, 566, 568, and 570 (shown in dashed lines to indicate that these are optional), in at least some embodiments the step 560 can be understood to include laser alignment and water plugging operations as discussed above. That is, at the sub step 562, a laser target is affixed to the far end of the internal channel 415 of the trunnion pin 218 and then, at the sub step 564, a laser is affixed onto the core drill 230 (or a shaft or other support feature thereof, such as the link 1102 of FIG. 11). Subsequently, at the sub step 566, alignment of the core drill 230 is performed using the laser sighter so that the core drill and (any drill bit mounted thereon) will be aligned with the central axis 314 of the trunnion pin 218. Further, once alignment is achieved, at a sub step 568 the laser is removed from the core drill and replaced with a desired core drill bit. Finally, at the sub step 570, the far end of internal channel 415 can be plugged with a water plug. Then once the assembly process is complete at the step 560, the process then is at the point G as discussed above and core drilling can be performed.

The present manner of assembly of the core drill assembly 226 is advantageous insofar as it allows for secure arrangement of the core drill 230 in a manner by which core drilling can be effectively and accurately performed, without damaging the tainter gate. Further, it allows for support of the core drill 230 to be provided entirely or substantially by the trunnion arms rather than upon one of the piers 102 and thereby avoids or minimizes any negative impact upon the piers/trunnion boxes (e.g., by avoiding the need to drill holes for support bracket components and the like into the trunnion box to support the core drill) or damage to the gate. Nevertheless, while FIG. 5B shows example steps of one process of assembling a core drill assembly for use in core drilling, it should again be understood that these steps are only intended to be examples, and also the components of the core drill assembly particularly discussed and shown in FIGS. 2B-3 and 12 are only examples of possible components. Also, it should be understood that one or more portions of the process of FIG. 5B can precede not only core drilling as used to drill out the core of a trunnion pin such as the trunnion pin 218, but also core drilling as used for other purposes, for example, in relation to the process F of FIG. 5A in which the trunnion bushing 220 is core drilled. Also, the same core drill assembly can be used to support a drilling machine for other non-drilling processes such as processes involving the application of torque (including, for example, the application of torque discussed with respect to the process E).

Support Structure

Figure 13:
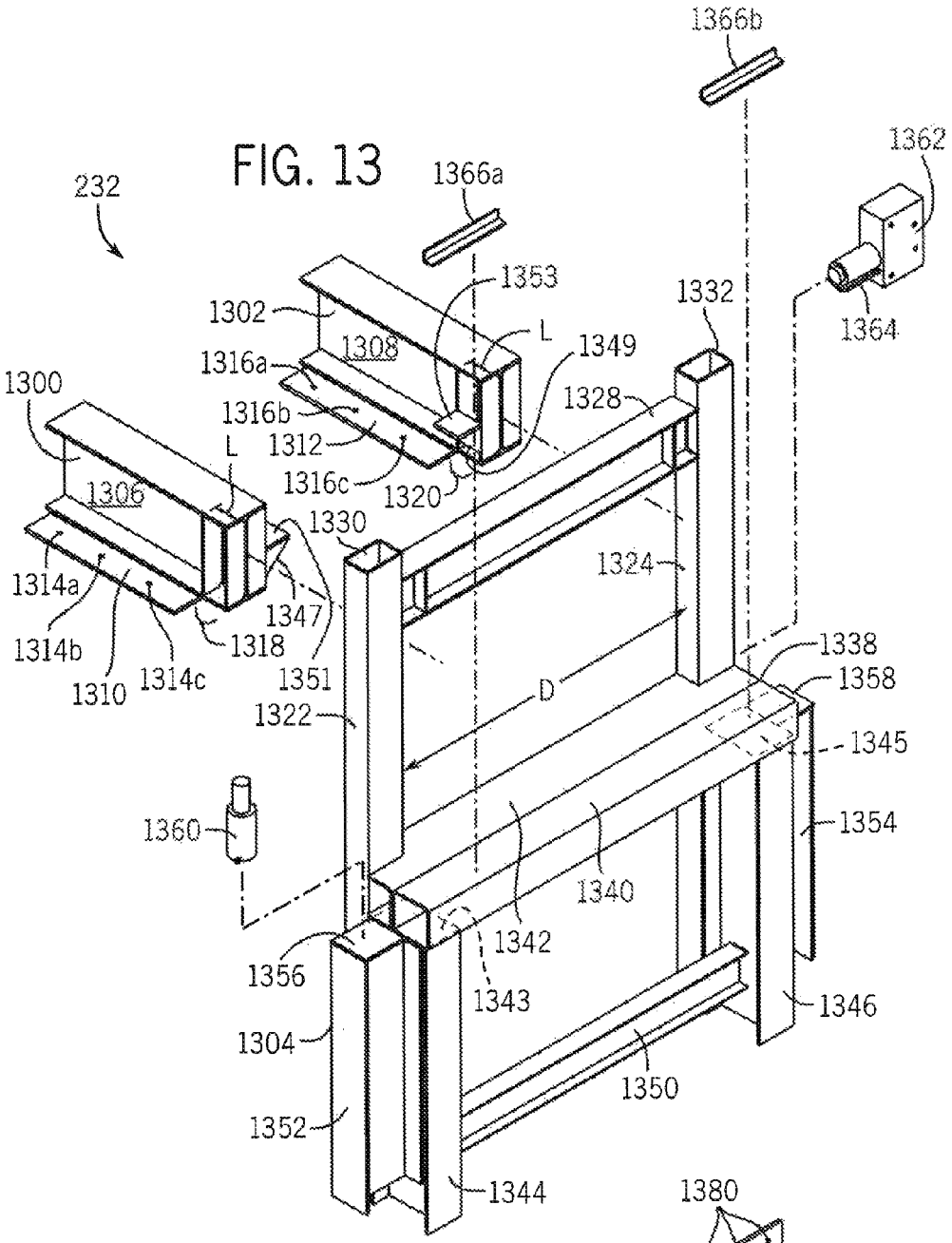
FIG. 13 is an exploded perspective view of the tainter gate support assembly of FIG. 2B in accordance with embodiments of the present disclosure.
Figure 14:
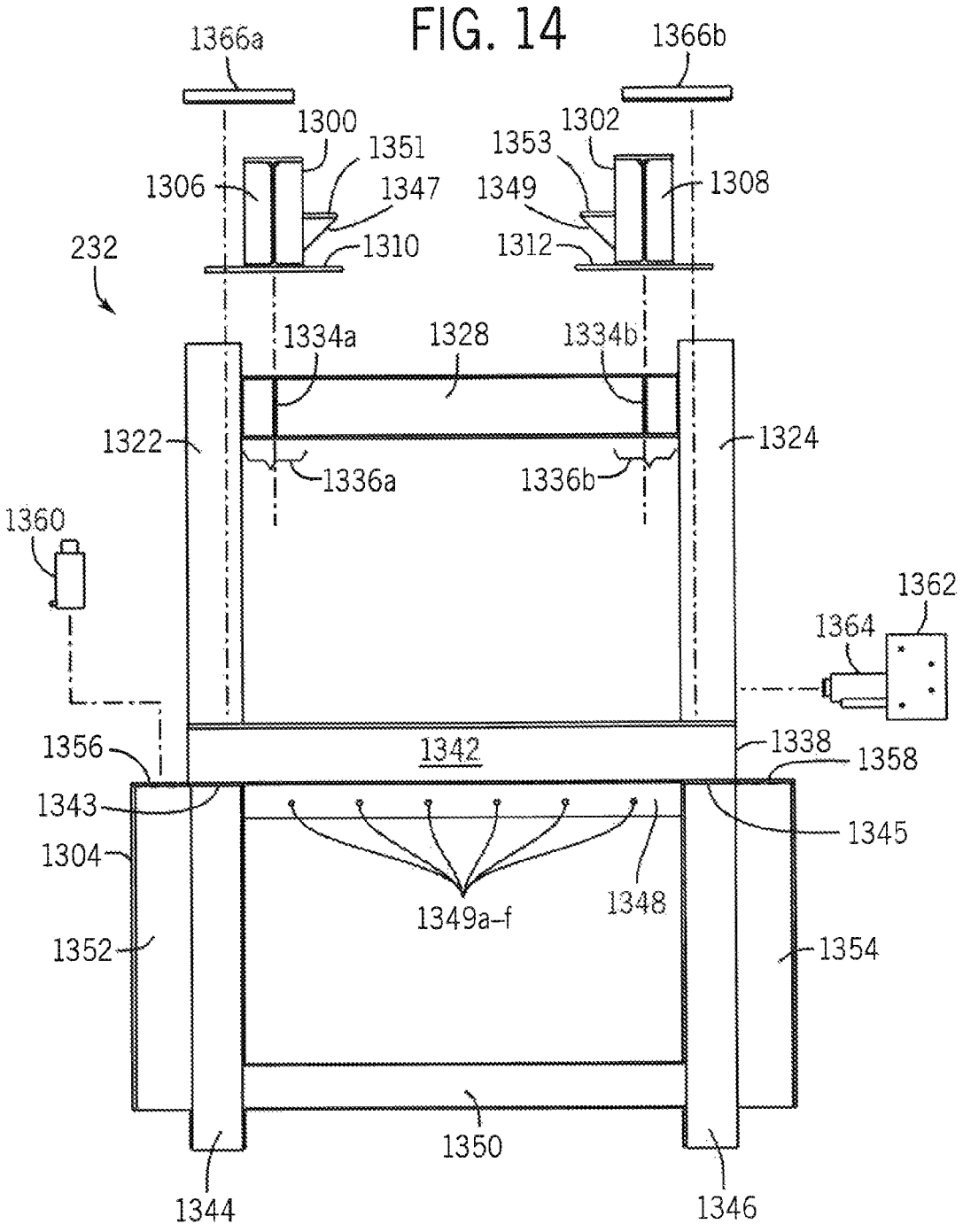
FIG. 14 is an rear elevation view of the tainter gate support assembly of FIGS. 13.

FIGS. 13 and 14 are exploded perspective and side views, respectively, of support structure 232 in accordance with exemplary embodiments of the present disclosure. Initially it is noted that dashed lines in the drawings generally show relative location of components when the structure 232 is assembled. And, in accordance at least some embodiments, the components making up the support structure 232 can be constructed of mild steel.

Referring to FIGS. 13 and 14, the support structure 232 generally comprises two pedestal assemblies 1300, 1302 well as a trunnion arm support assembly 1304. In accordance with at least some embodiments, each of pedestal assemblies 1300, 1302 comprises a respective beam or beam-like structure 1306, 1308 and a respective plate or plate-like structure 1310, 1312. In one non-limiting example, each pedestal assembly includes an American Institute of Steel Construction Engineering (AISC) W24×117>58.75"L beam (AISC Steel Construction Manual. 13$^{th}$ Edition, 2010), having multiple 22.563"L×6.125"W×½" Plate stiffeners, such as a stiffening gusset (or the like). Each respective plate or plate-like structure 1310, 1312 is respectively welded, or otherwise secured, to the respective beam or beam-like structure 1306, 1308. In one exemplary embodiment, the plate or plate like structures 1310, 1312 each include, or can take the form of, a 48"L×30"W×1" (thickness) plate. Each respective plate 1310, 1312 provides for attachment of the respective pedestal assembly 1300, 1302 to a pier such as the pier 102 depicted in FIG. 2B (which illustrates an example installation and/or use of the support structure 232), or similar structure, for example, at an upper or top surface of the pier, using a plurality of anchor mechanisms or similar attachment devices (not shown). In a representative embodiment, three opposing pairs of such anchor mechanisms are spaced apart lengthwise, so as to secure the respective pedestal assemblies 1300, 1302 via holes 1314*a-c* and 1316*a-c*, respectively, in the respective pedestal plates 1310, 1312 for appropriate anchoring of the respective pedestal assemblies to the pier (only three of the six holes on each of the base plates are visible in FIG. 13). One non-limiting example of an anchor mechanism is a one (1)-inch diameter, nine and a half (9.5)-inch embedment, concrete wedge anchor. Other devices and arrangements for spacing and anchorage are contemplated. Each of the pedestal assemblies 1300, 1302 are typically leveled (e.g., shimmed level) when secured to the pier using the respective plates (plate-like structures) 1310, 1312 and anchor mechanisms.

In at least some embodiments, each of the pedestal assemblies 1300, 1302 includes a cantilevered portion 1318, 1320 which includes a length "L" that extends over a side of a pier or similar structure to support the trunnion arm support assembly 1304, as described further below. In one embodiment, the length L of each of the cantilevered portions 1318, 1320 is approximately 8 inches.

Still referencing FIGS. 13 and 14, the gate support structure 232 further includes the trunnion arm support assembly 1304. The trunnion arm support assembly 1304 includes a pair of main members 1322, 1324. In one non-limiting embodiment, each of the main members 1322, 1324 includes, or can take the form, of AISC 12×8×⅝×179" long tubing. The main members 1322, 1324 are spaced apart from one another a distance D, and in at least one non-limiting embodiment, such spacing is eight (8), or approximately eight, feet.

The main members 1322, 1324 are connected together in spaced relation using a plurality of cross members as now described in conjunction with the representative illustration. A first, upper (or top) cross member 1328 is shown connected to or connecting the main members 1322, 1324 near respective upper ends 1330, 1332, respectively, and includes stiffeners 1334*a-b* as shown (see FIG. 14). In one non-limiting example, the first cross member 1328 includes, or can take the form of, an 8-foot long, ANSI W14×53-96" long beam, including a 12.6"L×3.55"W×⅝" plate stiffener or stiffener gussets. The first cross member 1328 also includes pedestal receiving regions 1336*a-b* (see FIG. 14) where the first cross member 1328 contacts or generally interfaces with the pedestal assemblies 1300, 1302, and more particularly, with the cantilevered portions 1318, 1320, of pedestal beam or beam-like structures 1306, 1308, respectively. Stiffening structures (e.g., stiffener gussets 1334*a-b*) are provided in this region for additional support of the pedestal assemblies 1300, 1302 when supported by the upper cross member 1328 at their cantilevering portions 1318, 1320 as shown and described herein.

The main members 1322, 1324 are further connected together in spaced relation using a cross member structure, generally referred to by numeral 1338, which also serves, in at least some embodiments, as the primary support or support region for a gate trunnion arm (e.g., the lower trunnion arm 210 of the tainter gate 104 as previously described) during, for example, repair of the tainter gate assembly 200, including particularly its trunnion pin 218 (see e.g., FIGS. 2A-B). The cross member structure 1338 comprises, as shown in FIG. 13, a pair of structural members 1340 and 1342. In one non-limiting example, structural members 1340, 1342, comprise, or take the form of, respectively, an AISC 12×12×⅝"×120" long tubing and an AISC 16×12×⅝"×120" long tubing, with the latter welded or otherwise joined to the former, and notched to fit in between the main members 1322, 1324. As such, the two structural members 1340, 1342 create a cross member structure 1338 that can be configured to provide a support area that is substantially larger than the width of the lower trunnion arm 204, 210 (FIGS. 2A-B). The cross member support structure 1338 is configured to support a lower trunnion arm in a level (e.g., horizontal) manner when the trunnion arm rests on the cross member support structure, while permitting relative movement (e.g., laterally or vertically) of the trunnion arm itself. Shimming maybe necessary to achieve leveling.

The structural members 1340, 1342 of the cross member structure 1338 are supported at least in part by additional support members 1344, 1346, positioned adjacent and oriented similarly (e.g., vertically) with respect to main members 1322, 1324. In one non-limiting example, each of the additional support members 1344, 1346, comprises, or takes the form of, an AISC W18×86-81" long beam structure that is welded, or otherwise joined, to (e.g., a front of) a respective one of the two main members 1322, 1324. Additional plate or plate-like structures 1343, 1345, which serve to distribute load, are sandwiched or otherwise located between each of the respective support (structural) members 1344, 1346 and cross member structure 1338. In one non-limiting example, the plate or plate-like structures 1343, 1345 comprise or take the form of 18.25"L×12"W×¾" plates and are welded to the support (structural) members 1344, 1346, respectively.

Further support of the trunnion arm support assembly 1304 is provided by a lower (or bottom), cross member 1350. In one non-limiting embodiment, the lower cross member 1350, includes, or can take the form of, an AISC W10×22×107.813" long beam (as shown, without additional stiffening structures). The lower cross member 1350 is welded or otherwise connected to additional support member 1344, 1346.

In the present embodiment, securing device 1348 additionally is shown in FIG. 14 to be connected to the cross member (support) structure 1338. In one non-limiting example, the securing device 1348 takes the form of an AISC 8"×8'×½"-96" long angle that is welded, or otherwise joined to, a bottom side (not shown) of the structural (support) member 1342, as well as being flush, or substantially flush, with a side intended to face the pier or similar structure. Further to this and other embodiments, six (6) 1-inch concrete wedge anchors, or similar anchoring mechanisms (not shown), can be installed via holes 1349*a-f* (again see FIG. 14) to secure the overall trunnion arm support assembly 1304 to the face of the pier, during use. Anchoring mechanisms such as the foregoing wedge anchors provide lateral support to resist a variety of forces, including, forces due to supporting a portion of the body of a gate assembly (e.g., a portion of the tainter gate assembly 200 shown in FIG. 2A), forces due to the fleet angle of the gate assembly hoist chains 225, and/or wind loads against the gate face (e.g., due to wind speeds which may be up to 60 mph, or possibly more), and further to provide resistance needed to jack or otherwise move the gate assembly (e.g., adjust trunnion arm 210 laterally or vertically) as described below.

Also as shown, additional members 1352, 1354 are respectively connected to main members 1322, 1324, respectively. In one non-limiting example, additional members 1352, 1354 include, or can take the form of, AISC W18×86-72" long beams which are welded to outside faces or surfaces of the main members 1322, 1324. At or near the top of these additional members 1352, 1354 are additional support structures 1356, 1358, respectively. In one non-limiting example, support structures 1356, 1358 can take the form of 12.625"L×12"W×¾-inch plates. One or more of additional members 1352, 1354 and the corresponding support structures 1356, 1358 are used to support a jack device (e.g., a hydraulic jack) 1360, for gate adjustment, one of which is shown in FIGS. 13 and 14 (in relation to member 1352 and structure 1356). As noted previously, there is a symmetry associated with the gate support structure 232 and provision for the additional members and associated support structures permits gate adjustment in more than one orientation. For example, the gate support structure 232 is symmetric at least insofar as its configuration permits use on either a right or left descending side of the gate assembly (e.g., gate assembly 200). In at least some embodiments, different types of jack devices can be assembled and utilized in relation to the same gate support structure 232. In the present embodiment, in particular, a jack support structure 1362 is also shown which is intended to be coupled to the lower trunnion arm 204, 210 of the previously described tainter gate assembly 200 (FIGS. 2A-B), and adjacent to the support structure 232 (which is in contact with the same lower trunnion arm as already noted). The jack support structure 1362 is used to support a jack device 1364.

FIGS. 13-14 additionally show representative locking devices (e.g., locking angle clips) 1366*a-b*, prior to attachment to the support assembly 232. In one non-limiting example, locking devices comprise, or take the form of, AISC 3"×3"×½"-24" long angle clip devices. These locking devices serve as guides to the lower trunnion arm 204, 210 when supported by the cross member structure 1338 and during adjustment of trunnion arm position (e.g., laterally, vertically) during repair/replacement of the trunnion pin 218 or other repair of the trunnion components. In at least some embodiments, the locking devices 1366*a-b* are notched and welded to cross member structure 1338. With additional reference to FIG. 2A, placement of the locking devices 1366*a-b* can be on each of the inside and outside edges of the lower trunnion arm 210 so that the locking devices 1366*a-b* are capable of assisting in preventing movement of the lower trunnion arm 210 once the trunnion (anchorage) pin 218 is removed. Additional and/or other devices can also be added for locking or other purposes.

Figure 13A:
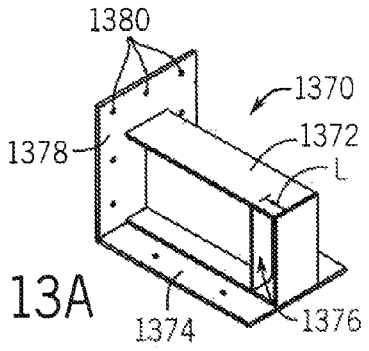
FIG. 13A is a perspective view of a portion of an alternative embodiment of a pedestal support assembly for use in relation to a roller gate pier.

As noted herein, the support structure 232 can be used in conjunction with a tainter gate assembly 200. Modification may be made such that, in other embodiments, the support structure 232 can be used on tainter gates with pier arrangements other than a tainter gate pier, including a roller gate pier or abutment wall. In contrast to FIG. 13, FIG. 13A illustrates an exemplary pedestal mounting assembly 1370 that is configured for use with a roller gate pier, such as pier 107 (FIG. 1). As with the pedestal assemblies 1300, 1302 of FIG. 13, the assembly 1370 again includes a beam or beam-like structure 1372 that is connected to a support plate or plate-like structure 1374 for connection to a surface of the pier or similar structure (not shown). In one non-limiting example, the beam 1372 can include a W24×117 support beam and the plate 1374 can include a 1" plate. The pedestal mounting assembly 1370 again includes a cantilevered portion 1376 above which is an area having a length L for supporting (typically along with an additional pedestal mounting assembly that is that same or similar to the pedestal mounting assembly 1370) a trunnion arm support assembly (e.g. assembly 1304 as previously disclosed). An additional plate 1378 (e.g., a 1" plate) is shown welded or otherwise joined to a surface (e.g. a rear surface) which is bolted or otherwise connected to a roller gate pier surface or wall via anchors (not shown) connected through plurality of holes 1380. It will be understood that many modifications can be made to support structure 232 in accordance with various embodiments of the present disclosure. For example, in some alternate embodiments, only a single pedestal mounting assembly, or more than two pedestal mounting assemblies, are used to support the trunnion arm support assembly.

In general, it should be understood that appropriate shimming is included as required to accomplishing leveling and the like. In accordance with at least some embodiments, stiffening structures (e.g., web stiffeners) are welded or otherwise secured in and/or to the pedestal mounting (or support) assemblies (e.g., at support or beam flanges) generally at a location where a respective trunnion arm support rests.

Support Structure Use

FIGS. 15-30 illustrate installation and/or use of the support structure 232 in accordance with embodiments of the present disclosure. Movement of the support structure 232 (or components of the structure) is illustrated in these Figures. It will be understood that, in addition to manual adjustment, movement may be accomplished in an automated manner, for example using a crane or other machine (not shown) in conjunction with hoist chains, cables, or other devices (shown schematically in FIGS. 18-19). It will be understood that while use is illustrated and described with respect to a tainter gate assembly 200 and the gate support structure 232 as previously described, the methods described herein are illustrative and non-limiting.

Figure 15:
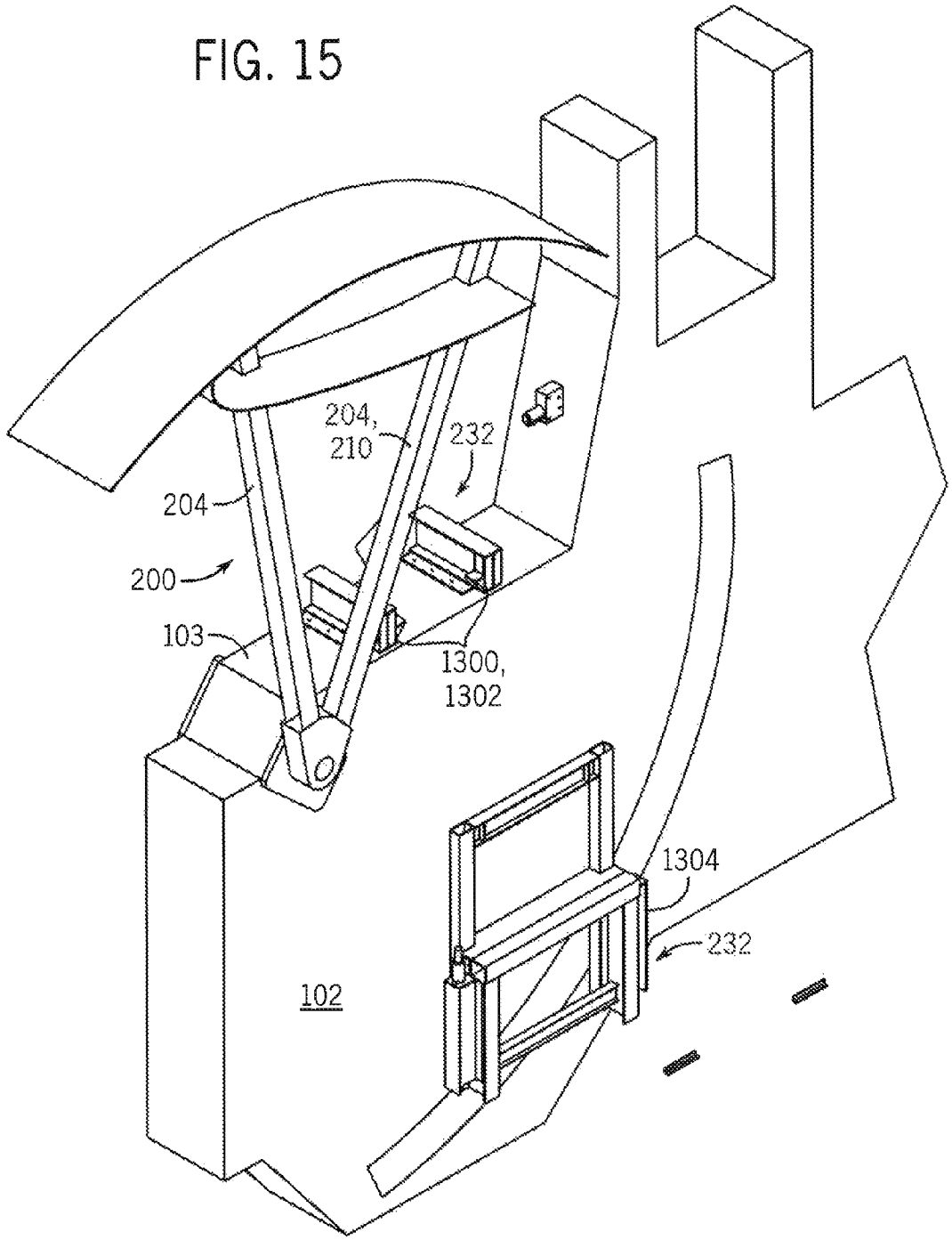
FIGS. 15-30 are further schematic views illustrating use of the tainter gate support assembly of FIGS. 13 and 14 in accordance with exemplary embodiments of the present disclosure.

FIG. 15 illustrates an initial view of the support structure 232 shown, including pedestal assemblies 1300, 1302 and trunnion arm support assembly 1304. The support structure 232 is shown prior to providing support for a representative tainter gate assembly 200 that is secured to a pier such as the tainter gate pier 102 as previously described with respect to FIGS. 2A-2B. The tainter gate assembly 200 is shown in a fully raised position such that the trunnion arms 204, and more particularly the upper and lower trunnion arms 208, 210, are positioned so as to extend upwardly above the pier 102 (as shown, in the form of a "V"). The pedestal assemblies 1300, 1302 are shown initially positioned in relation to one another and on a top or upper surface 103 of the pier 102, but in accordance with at least some embodiments of the present disclosure, the pedestal support beams 1306, 1308 are not yet fastened to the pier, so that the pedestal beams can be at least relatively easily moved to a supporting position as described below.

Figure 16:
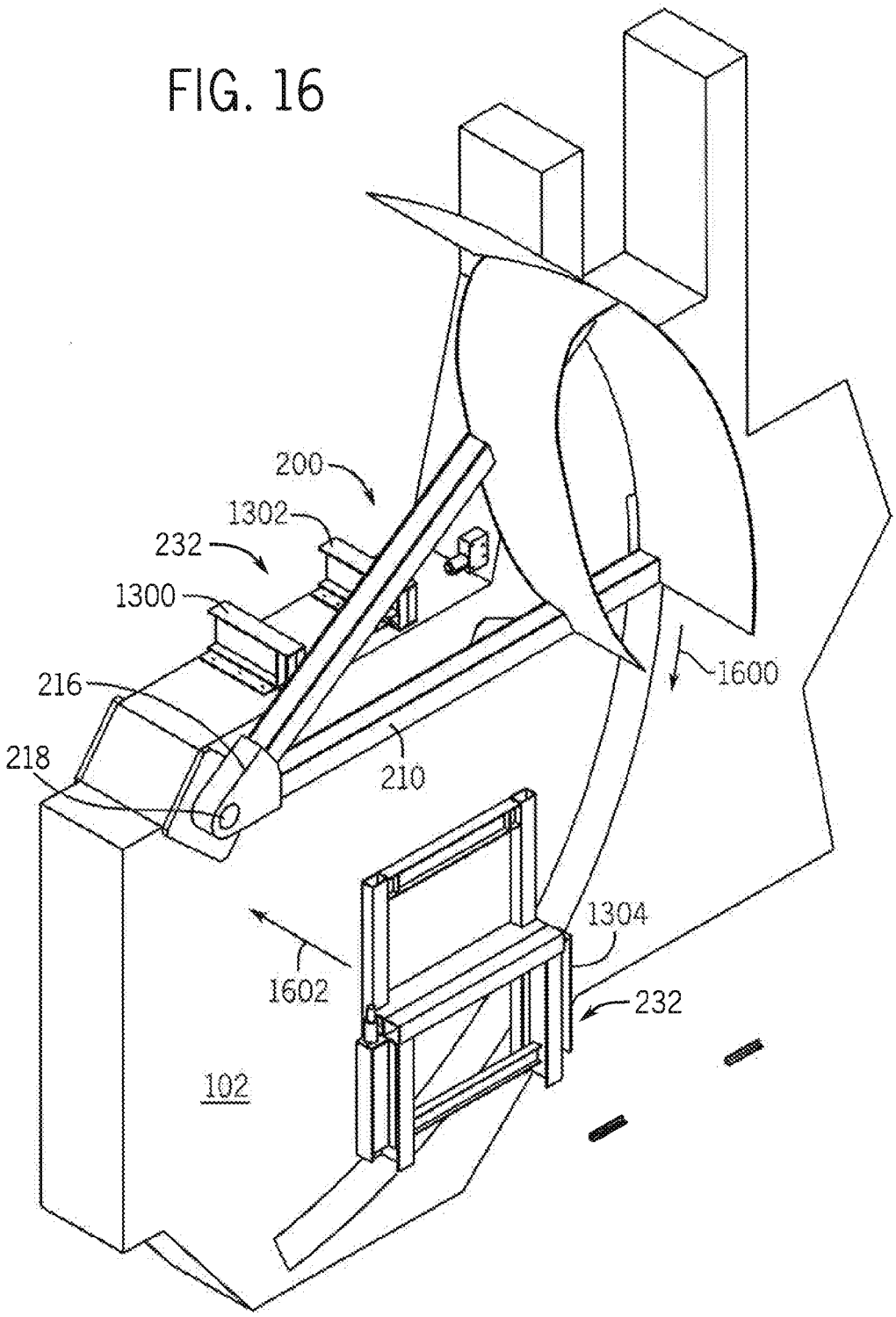

With additional reference to FIG. 16, a representative initial action can be seen. That is, the tainter gate assembly 200 is lowered, via the support components which include the trunnion box 216 and the trunnion pin 218 as previously described, in a direction indicated by arrow 1600. More specifically, the tainter gate assembly 200 is lowered to a level or substantially level lowered position. In accordance with at least some embodiments of the present disclosure, the level or substantially level lowered positioned corresponds to a position in which the lower trunnion arm 204 is at least generally horizontal. The pedestal assemblies 1300, 1302 and trunnion arm support assembly 1304 of the support structure 232 are shown in the positions previously illustrated in FIG. 15, although trunnion arm support assembly is about to be moved towards the pier 102, as indicated by arrow 1602.

Figure 17:
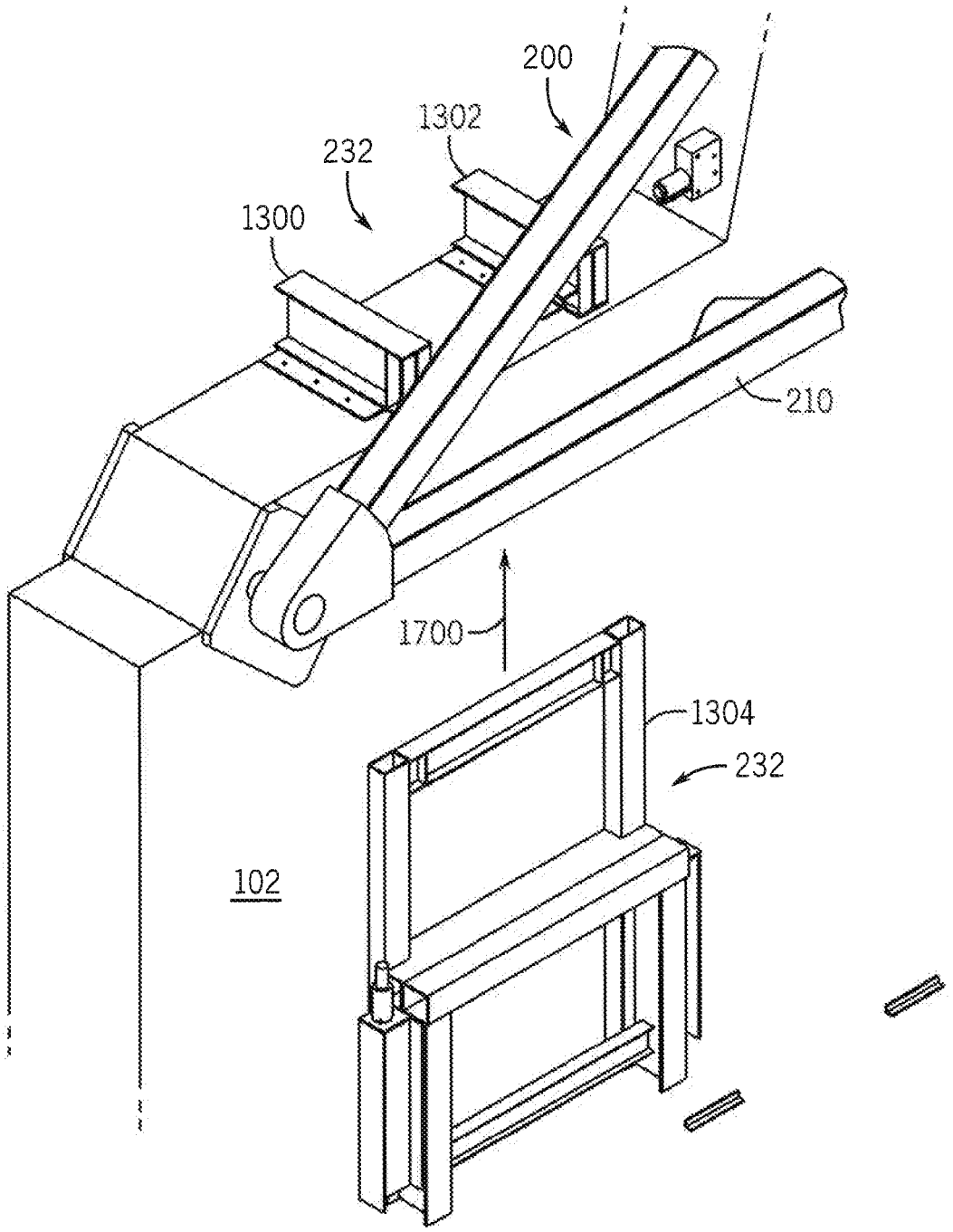

With additional reference to FIG. 17, another representative action relating to the use of support structure 232 can be seen. Now, the trunnion arm support assembly 1304 of the support structure 232 has been moved towards and proximate the pier 102, below the tainter gate assembly 200. As indicated by arrow 1700, the trunnion arm support assembly 1304 is about to be moved upwardly and toward the lower trunnion arm 210 of the tainter gate assembly 200 (which again is in the level or substantially level lowered position) and towards the pedestal assemblies 1300, 1302.

Figure 18:
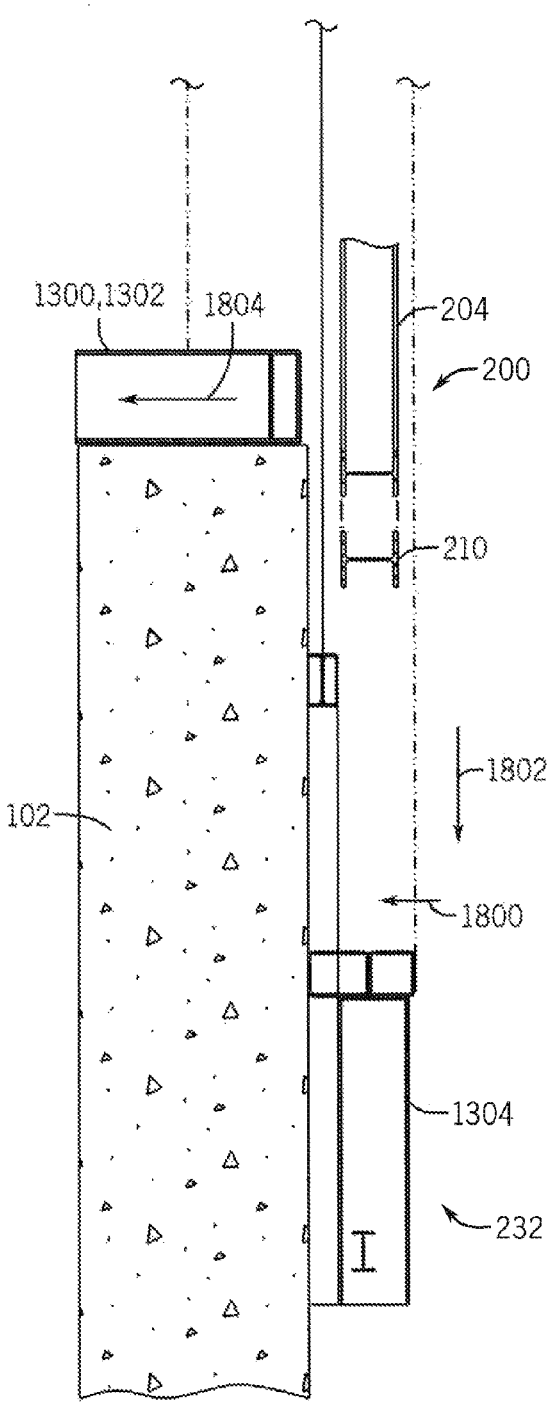
Figure 19:
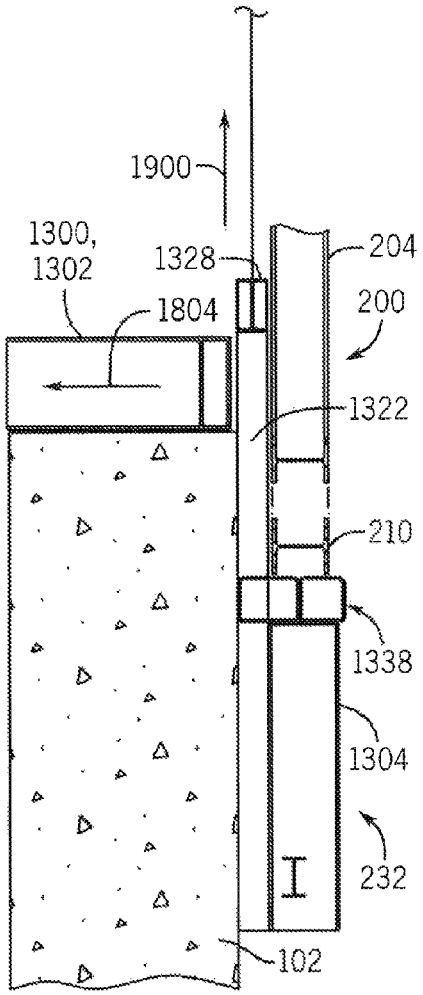
Figure 20:
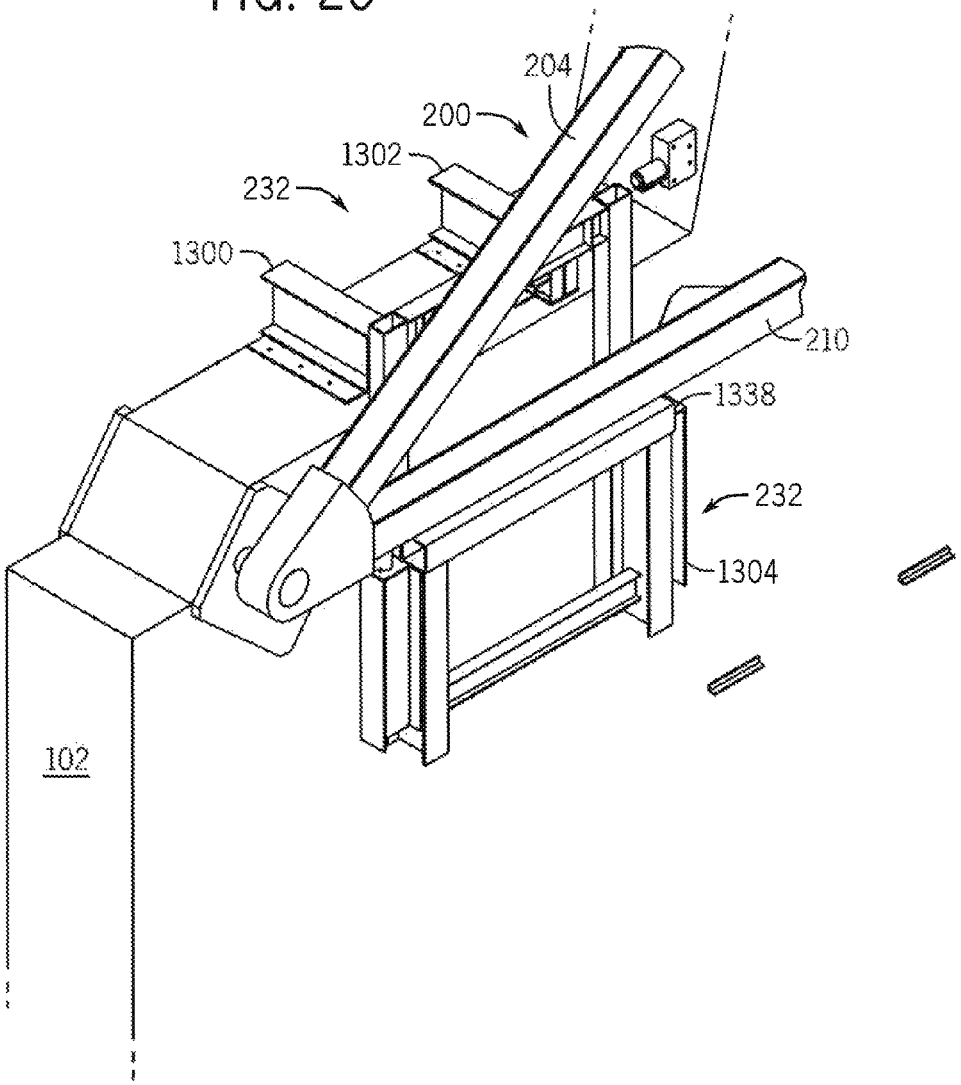

With additional reference to FIGS. 18-20, additional representative actions in the support structure 232 installation and/or use are shown. FIGS. 18 and 19 are both cross-sectional cutaway views showing positions of the pier 102, tainter gate assembly 200, and support structure 232, while FIG. 20 provides a perspective view of these components. In FIG. 18 (and as previously described with particular reference to FIG. 16), the trunnion arm support assembly 1304 of the support structure 232 has been moved towards and proximate the pier 102, below the tainter gate assembly 200, with representative motion indicated by arrow 1800. Additional movement downwardly may be optionally necessary to ensure that that the assembly 1304 is positioned appropriately with respect to the tainter gate assembly 200, and particularly the lower trunnion arm 210, and this optional movement is shown by arrow 1802. In FIGS. 19 and 20, the support structure 232 is now shown to have been raised upwardly, indicated by arrow 1900 along and proximate the pier 102, and further towards and proximate the tainter gate assembly 200. More specifically, cross member structure 1338 of the trunnion arm support assembly 1304 of the support structure 232 is positioned so that it is contacting, or at least about to contact, lower trunnion arm 210 of the tainter gate assembly 200. Further, it can be seen that at least a portion of the support assembly 1304, particularly a portion above the cross member structure 1338 (including, by way of example and as shown, portions of the main members 1322, 1324), is both proximate and between both the pier support 102 and the trunnion arms 204 of the tainter gate assembly 200. As shown, pedestal supports 1300, 1302 are still positioned in the original position, which is away from the tainter gate assembly 200, as indicated by arrows 1804. The first cross member 1328 is shown to be positioned above the pedestal supports 1300, 1302.

Figure 21:
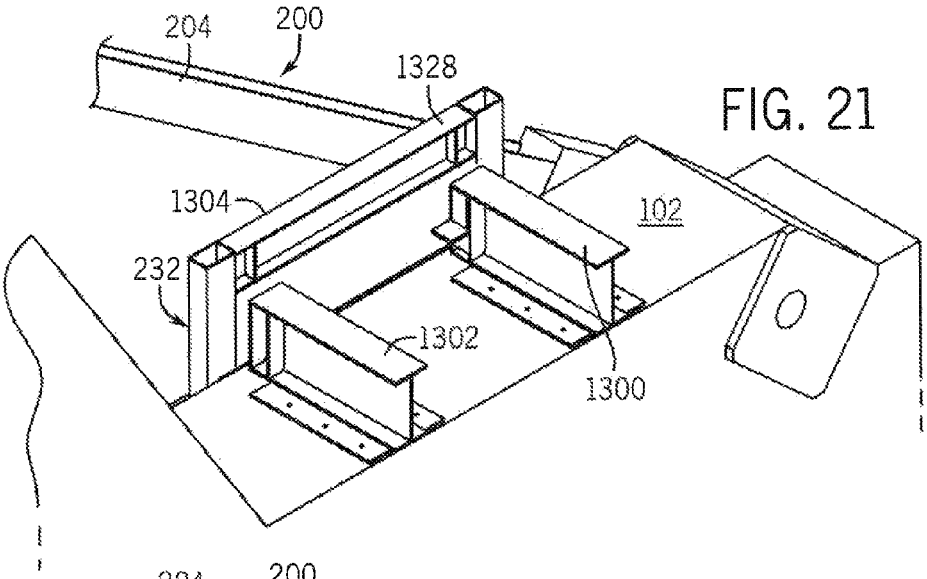
Figure 22:
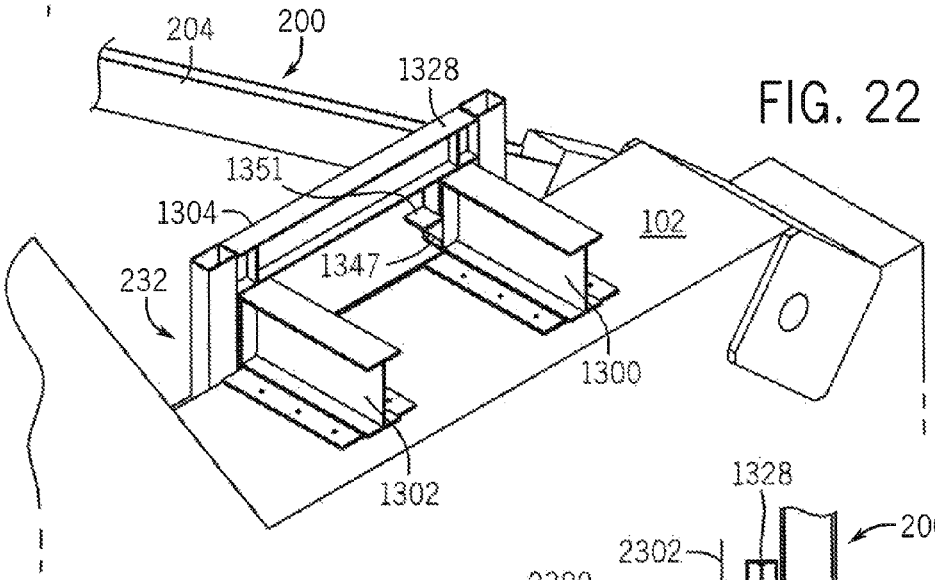
Figure 23:
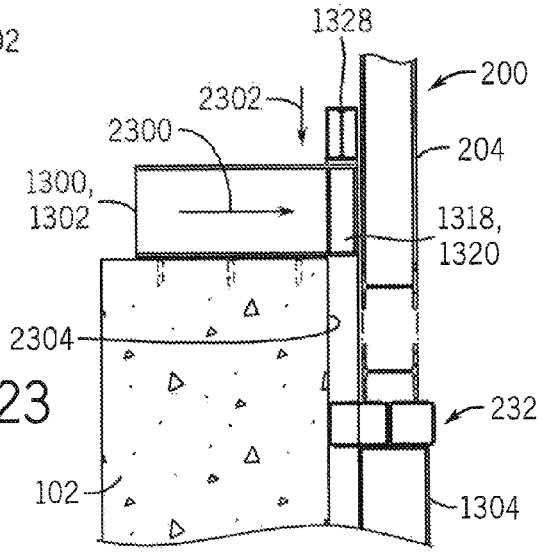

FIGS. 21 and 22 are perspective cutaway views of the pier 102, tainter gate assembly 200 and support structure 232 from an opposite side (as compared to the previous illustrations in FIGS. 17 and 20). FIG. 23 is a view similar to that of FIG. 19, but only of an upper portion thereof and showing movement and/or positioning the pedestal assemblies 1300, 1302. More particularly, with additional reference to FIGS. 21-23, and as previously described, at least a portion of the support structure 232 is positioned both proximate and between the pier 102 and the trunnion arms 204 of the tainter gate assembly 200. In FIG. 21, the pedestal assemblies 1300, 1302 are located on the pier 102. The first cross member 1328 is still shown to be positioned above the pedestal supports 1300, 1302.

Referencing additionally and in particular FIGS. 22-23, the pedestal assemblies 1300, 1302 have been moved (e.g., in a manual or automated manner) towards, so as to engage, the trunnion arm support assembly 1304, with such movement indicated by arrow 2300 (see FIG. 23). More specifically, with the trunnion arm support assembly 1304 suspended (e.g., using a crane, hoist chains, etc.) in a stationary or substantially stationary manner, the pedestal support assemblies 1300, 1302 are lifted, slid or otherwise moved (separately or simultaneously) towards the trunnion arm support assembly 1304. In accordance with at least some embodiments of the present disclosure, and as best seen in FIG. 23, the pedestal assemblies 1300, 1302 are moved so that the cantilevered portions 1318, 1320 of the pedestal support assemblies each extend, so as to overhang, a side or edge 2304 of the pier 102. In this way, and in accordance with at least some embodiments of the present disclosure, the pedestal support assemblies 1300, 1302 extend, so as to interface with and/or engage, at least a portion of the trunnion arm support assembly 1304 (e.g., the first cross member 1328) such that the trunnion arm support assembly 1304 hangs from the pedestal support assemblies. With reference to FIGS. 21-23, the pedestal assemblies 1300, 1302 are typically anchored to the pier 102 using devices, for example using anchoring mechanisms (shown in phantom in FIG. 23) via holes formed in the pedestal assemblies as previously described. In this way, the pedestal assemblies 1300, 1302 are generally rigidly mounted to the pier 102. In addition, although not shown, the cross member structure 1338 is generally rigidly mounted to the pier 102, such as by way of the securing device 1348 and anchoring mechanisms described above with respect to FIG. 14.

With reference to FIGS. 13, 14 and 22-23, pedestal assemblies 1300, 1302 are shown to further include additional support structures 1347, 1349, respectively. Each of these additional support structures 1347, 1349 is further capped by plate or plate-like structures by 1351, 1353, respectively. These additional support structures 1347, 1349 and the respective plate or plate-like structures 1351, 1353 can be used to support one or more jacking or similar devices that in turn can be used to ensure or otherwise provide for alignment and/or fit of the support structure 232 (e.g., alignment and/or fit between the trunnion arm support assembly 1304 and the pedestal support assemblies 1300, 1302). In one non-limiting example, each of additional support structures 1347, 1349 includes or can take the form of 7.5"Leg×7.5"Leg×½" plate and the each plate or plate-like structure 1351, 1353 includes or can take the form of 7.785"L×7.5"W×1" plate.

Figure 24:
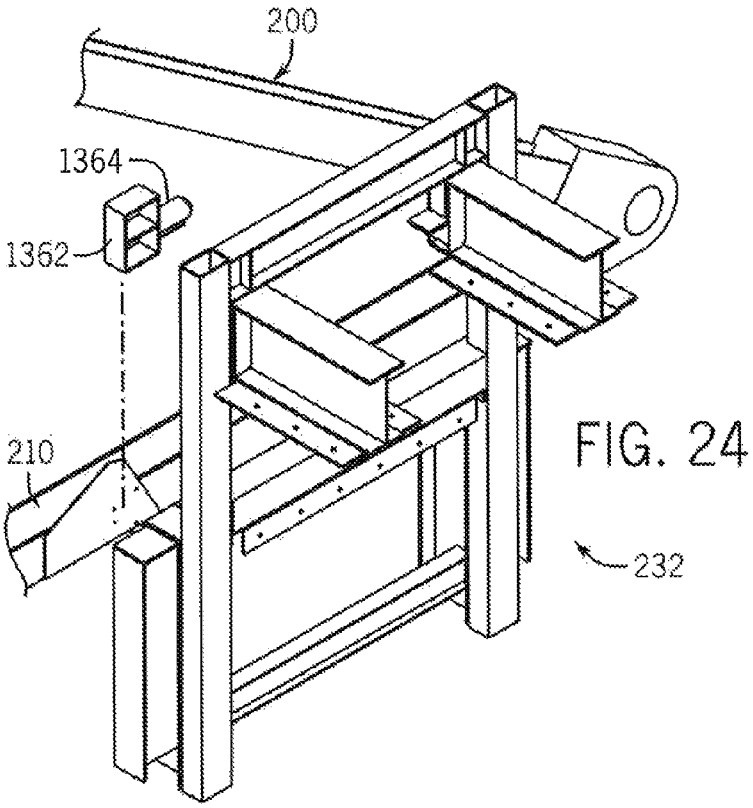
Figure 25:
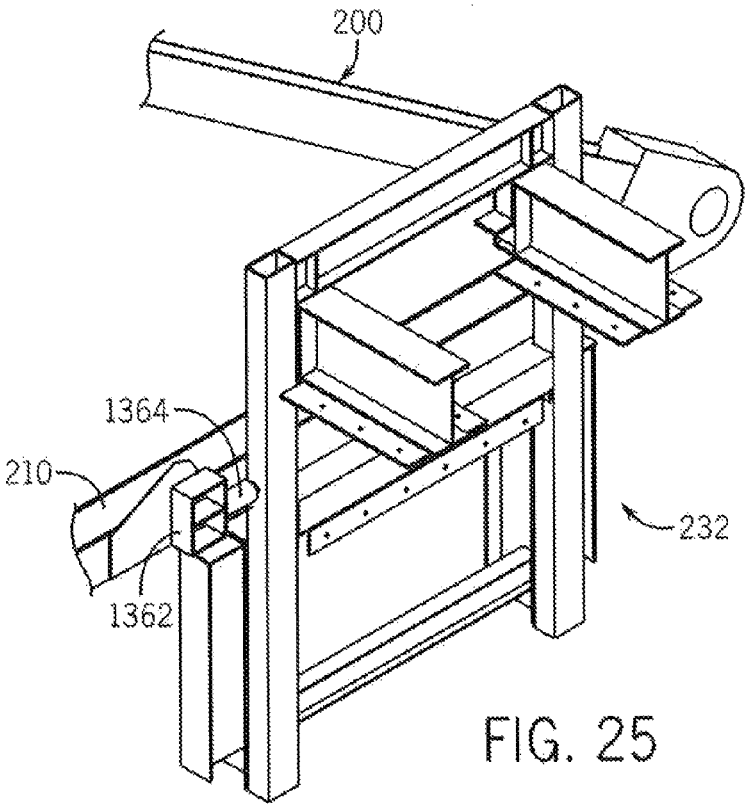

With additional reference to FIGS. 24 and 25, positioning of the support structure 232, tainter gate assembly 200 and trunnion arms 204 remains the same as shown in FIGS. 22-23, but in this instance, the pier 102 is no longer shown. Assembly or installation of the jack support structure 1362 and associated jack device 1364 with respect to the lower trunnion arm 210 of the tainter gate assembly 200 is illustrated. The jack support structure 1362 and associated jack device 1364 are utilized, in accordance with at least some embodiments, to provide side-to-side or lateral (e.g., horizontal upstream or downstream) movement of the tainter gate assembly 200. In at least some embodiments, the jack support structure 1362 comprises a box or box-like structure. In one non-limiting embodiment, the box-like structure includes top and bottom 11.625"L×6.25"W×¾"plates, left and right side 19"L×7.75"W×¾"plates, a rear or back 17.5"L×11.625"W×¾"plate and a centrally disposed support gusset 11.625"L×7"W×¾" plate and the jack device 1364 is further supported by a jack support structure 1362 taking the form of an ANSI 8"×0.322"-10" long pipe section.

Figure 26:
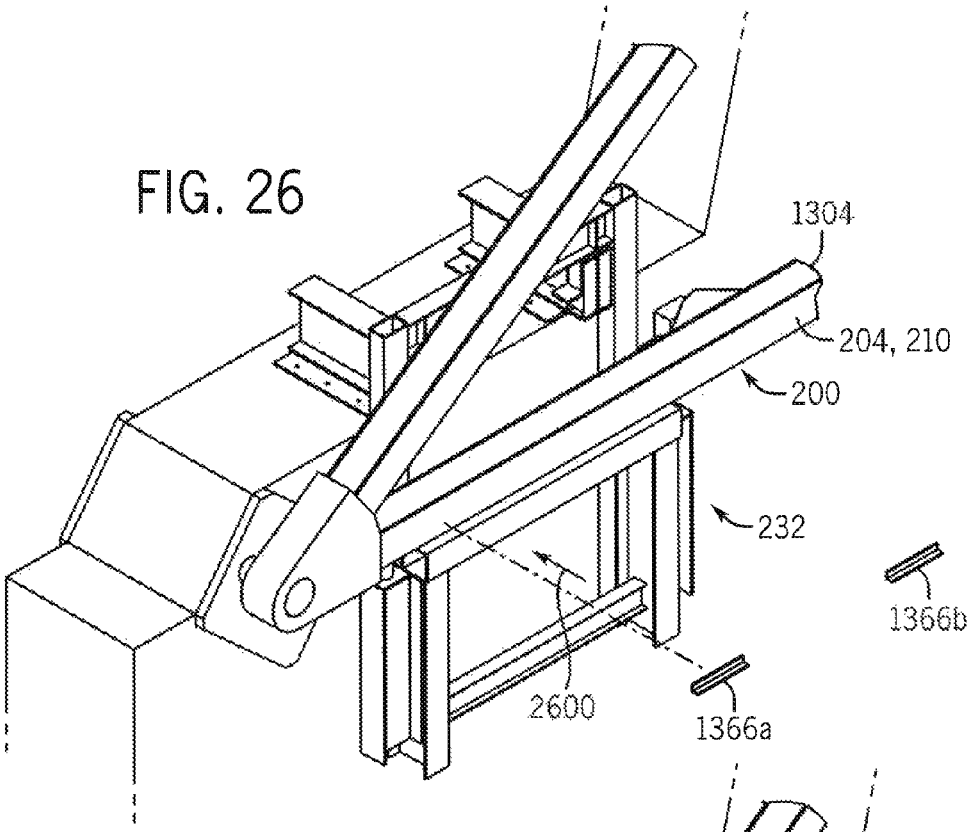
Figure 27:
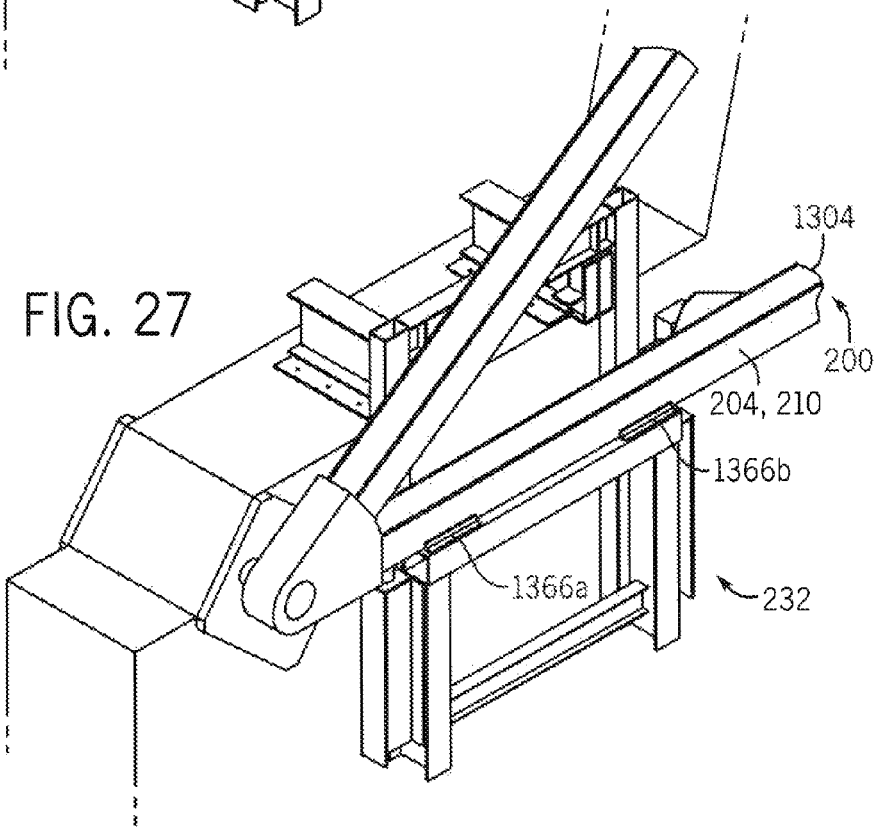
Figure 28:
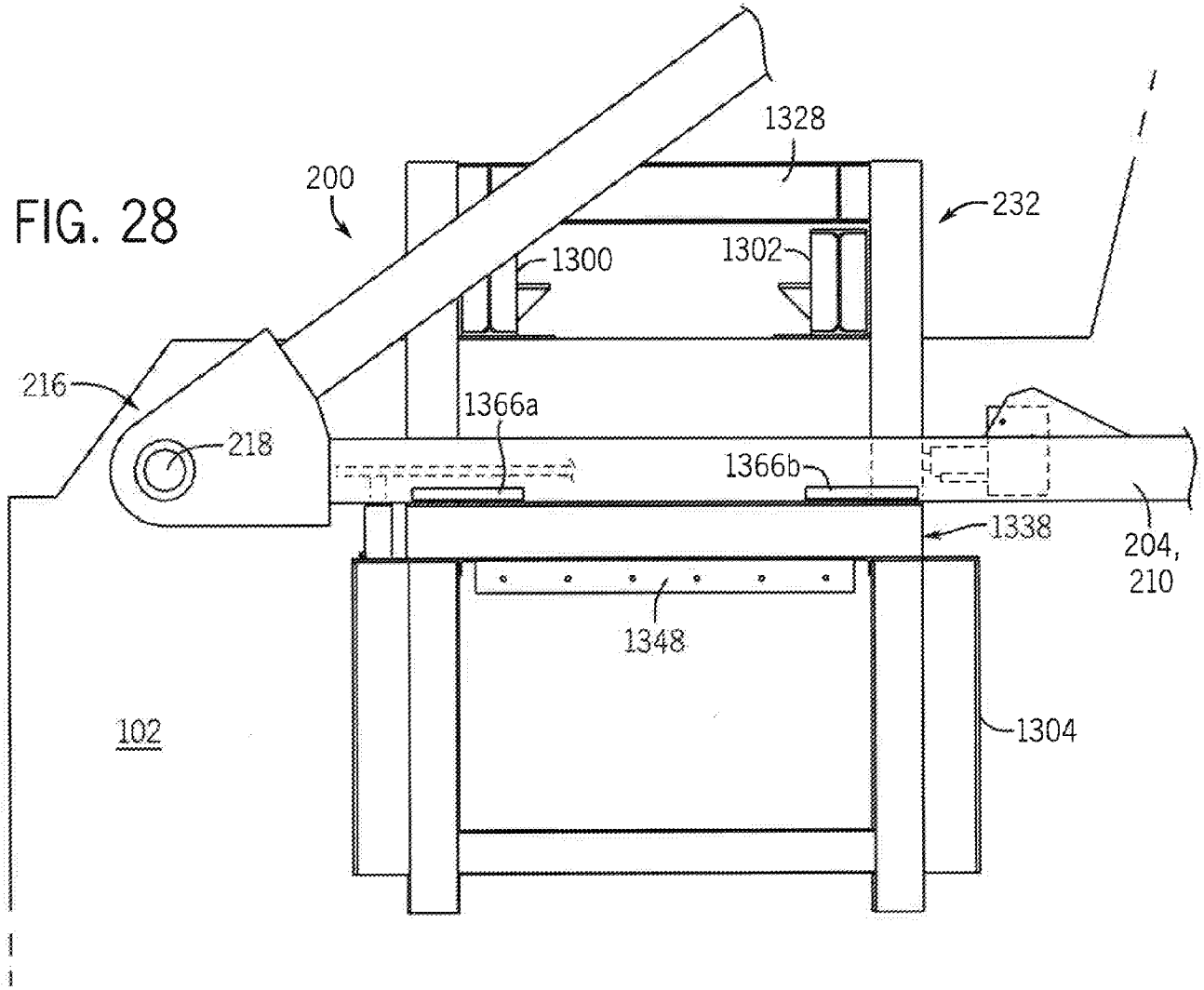

With additional reference to FIGS. 26-28, views are shown at a point in the installation procedure similar to that of FIG. 24-25, but from a location illustrating the opposite side (FIGS. 26-27 are perspective views and FIG. 28 is a front or side elevation view) of the tainter gate assembly 200, the support structure 232, and now further illustrating the pier 102. The tainter gate assembly 200 is connected to the pier 102 via trunnion box 216 and trunnion pin 218 as previously described. The trunnion arm support assembly 1304 is suspended in position, via first or upper cross member 1328, and from the pedestal support assemblies 1300, 1302 and so the support structure 232 is shown to support the lower trunnion arm 204, 210 of the tainter gate assembly 200 (it is understood that partial support is provided as additional support is provided by hoist chain 225 previously described with respect to FIG. 2A). Representative locking devices (e.g., locking angle clips) 1366*a-b* are shown prior to and following securing, with this action or movement indicated by arrow 2600. The support structure 232 is secured to the pier 102 at least in part by the securing device 1348 that is connected to the cross member structure 1338 as previously described. At least a portion of the support structure 232 is between the pier 102 and the trunnion arms 204 of the tainter gate assembly 200.

Figure 29:
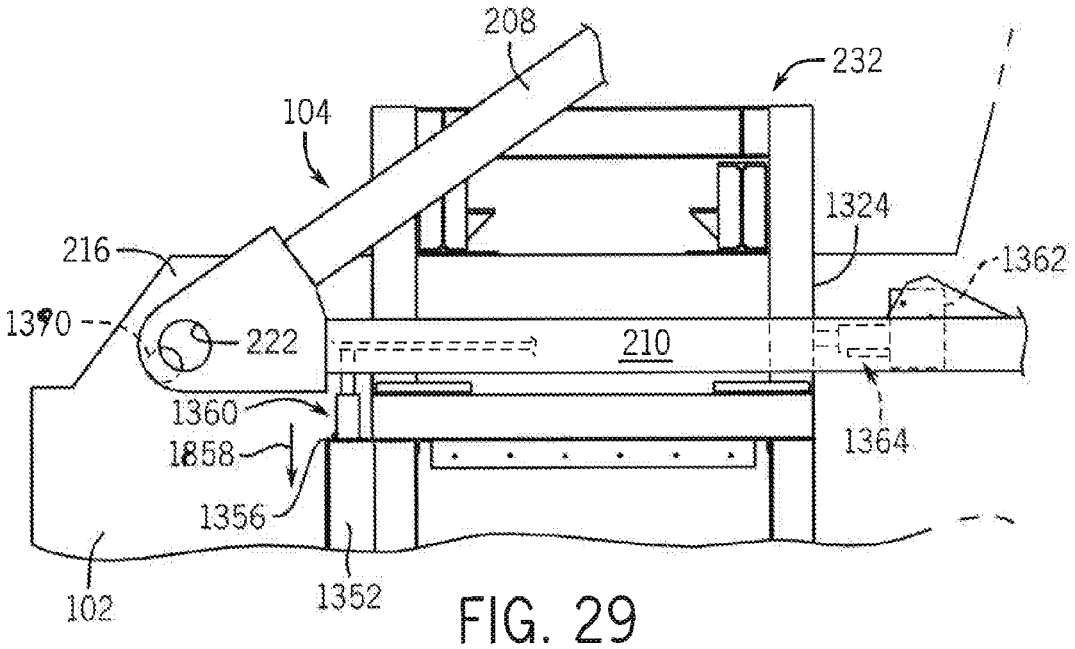
Figure 30:
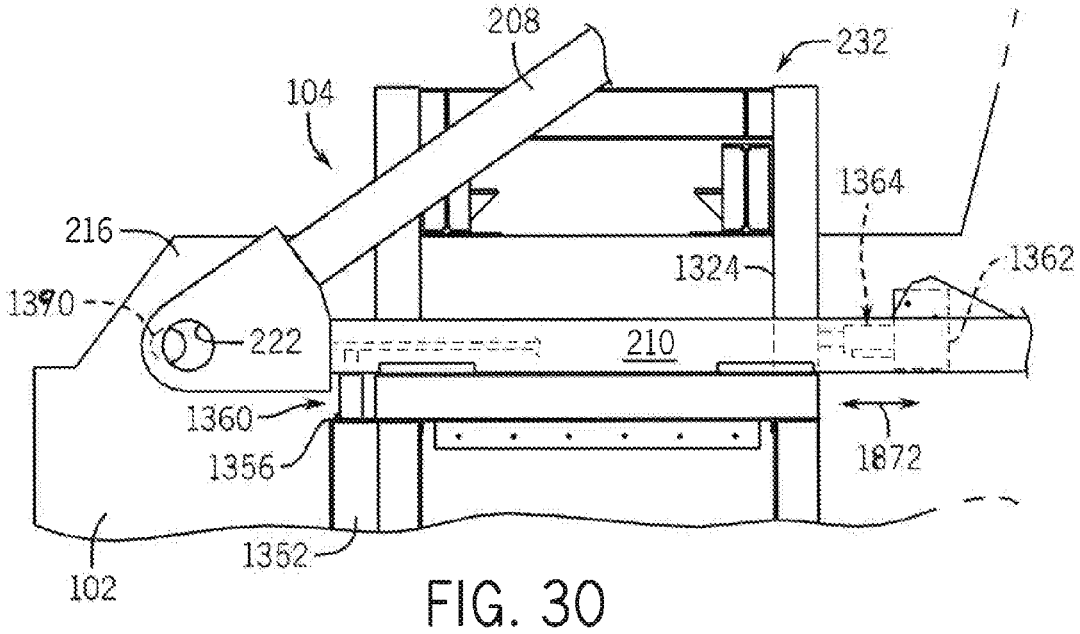

Turning to FIGS. 29 and 30, the support assembly 232 in the present embodiment particularly allows for adjustments (including relatively fine adjustments) to the positioning of the tainter gate 104 of the tainter gate assembly 200 with which the support assembly is contact, relative to the trunnion box 216 (and the pier 102) with respect to which the tainter gate is normally supported when a trunnion pin is present. Such adjustment can be of particular value during the trunnion pin removal/replacement process after a preexisting trunnion pin (e.g., the trunnion pin 218 discussed above) has been removed and it is desired to provide a new trunnion pin in its place. This is because, upon the removal of the preexisting trunnion pin it is possible for the tainter gate 104 to experience some vertical and/or horizontal (along the axis of the flow of the water 105 upstream to downstream) travel and/or shifting when the tainter gate is no longer supported by the preexisting trunnion pin and its weight is borne solely by the support assembly 232 and the hoist chain 225. As a consequence of such shifting, holes 1390 within the trunnion box 216 (and particularly within the anchor plates 302, 304 of the trunnion box) 216 for receiving the new trunnion pin can become misaligned relative to the orifice 222 within the casting 224 of the tainter gate 104 within which is to be positioned a new annular trunnion bushing (not shown) that in turn will also receive the new trunnion pin, as shown particularly in FIG. 29. In other words, the central axis of the holes 1390 can be misaligned relative to the central axis of the orifice 222 as illustrated in FIGS. 29 and 30.

To afford such adjustment capability by which such misalignment can be corrected, the support assembly 232 supporting the lower trunnion arm 210 of the tainter gate 104 in FIGS. 29 and 30 additionally includes both the additional support structure (which is a vertical support plate) 1356 at the top of the additional member 1352 of the support assembly 1304 and a vertical jack 1360 attached to that additional support structure, and also the jack support structure (or horizontal bracket) 1362 along with the jack device (which is horizontally-oriented) 1364 attached to that jack support structure/horizontal bracket. More particularly, the jack device 1364 is arranged to extend between the jack support structure/horizontal bracket 1362, which is itself attached to the lower trunnion arm 210 along which it is positioned, and the main member 1324 of the support assembly 232. In at least some embodiments, the jack support structure/horizontal bracket 1362 is attached to the lower trunnion arm 210 by structurally secure fasteners (e.g., ¾-inch A325 structural bolts). Further, the (vertical) jack device 1360 is arranged to extend between the additional support structure (vertical support plate) 1356 and a lower surface of the lower trunnion arm 210.

Each of the vertical jack device 1360 and the horizontal jack device 1364 in the present embodiment are hydraulic cylinders, and the pressures and lengths of both cylinders can be independently adjusted by controlling pressurized hydraulic fluid communicated to and within the cylinders as determined by a control mechanism or controller (not shown). It is possible, in some embodiments, for the hydraulic cylinders to be double-acting such that the cylinders can be both extended and retracted by directly controlling hydraulic fluid pressure to the cylinders. Nevertheless, in the present embodiment the hydraulic cylinders are particularly actuatable to be extended (by providing hydraulic fluid pressure to the cylinders) but, for retraction, are retracted passively in response to the weight of the tainter gate 104. That is, in the present embodiment, the vertical jack device 1360 can be retracted simply due to the weight of the tainter gate 104 bearing thereon. Further, the horizontal jack device 1364 can also be retracted due to the weight of the tainter gate 104 in combination with the operation of the hoist chain 225, since when the hoist chain 225 is not vertical (plumb), the weight of the tainter gate tends to swing the gate horizontally in a direction tending to modify the fleet angle and return the hoist chain to a vertical position. It should be further noted that, due to the presence of the hoist chain 225, in at least some embodiments at least the horizontal jack device 1364 is a necessary or highly desirable component because the tainter gate 104 will naturally tend to experience some horizontal shifting due to the swinging permitted by the hoist chain 225, and so the horizontal jack device will be employed to address/counteract that natural shifting/swinging and provide support.

By virtue of this arrangement, and particularly actuation of the vertical jack device 1360 and horizontal jack device 1364, it is possible to make adjustments to the positioning of the tainter gate 104 so as to correct misalignments as mentioned above (or otherwise). An example manner of making such adjustments is evident as well from FIGS. 29 and 30. More particularly in this regard, when both vertical and horizontal adjustments are required as is shown to be the case in FIG. 29, the adjustments are made in two steps. First, any vertical or substantially vertical adjustment is made by actuation of the vertical jack device 1360. In FIG. 29, the required vertical adjustment is a downward (or substantially downward) adjustment, as represented by an arrow 1858, albeit in other cases the required adjustment could be in the opposite (upward) direction. Second, any further horizontal adjustment is then additionally made by way of actuating the horizontal jack device 1364, so as to result in proper alignment (e.g., so that the central axes of the holes 1390 and orifice 222 are aligned). FIG. 30 illustrates such a horizontal alignment, which is represented by an arrow 1872. Again, while the arrow 1872 illustrates movement in one direction, horizontal adjustments can also be made in the opposite direction.

It should be noted that the above manner of adjusting the position of the tainter gate 104 is particularly effective in adjusting the portion of the tainter gate which is near the pier 102 with respect to which the support assembly 232 is in contact, and may not be effective (or as effective) in adjusting the portion of the tainter gate at the opposite end of the gate portion 202 that is supported by another (complementary) support assembly that is in contact with another one of the piers. To achieve appropriate adjustments of all portions (e.g., both sides) of the tainter gate 104, therefore, it will typically be appropriate to perform vertical and/or horizontal adjustments at both sides of the tainter gate by way of the respective support assemblies 232 at those respective sides, and it should be understood that each of the support assemblies along each respective side of the tainter gate will typically be provided with the same adjustment mechanism components (e.g., vertical and horizontal jack devices) as have been discussed in relation to FIGS. 29 and 30 in relation to the support assembly 232 along one side of the tainter gate 104.

Further, notwithstanding the above description, in at least the present embodiment, the vertical and horizontal directions represented by the arrows 1858 and 1872 need not be exactly vertical and horizontal relative to the ground, since there can be some rotational shifting of the tainter gate 104 as well as translational shifting, and since the vertical jack device 1360 only is in contact with the lower trunnion arm 210 at a single location. Allowing for such rotational shifting can be desirable to accommodate ongoing interaction of the tainter gate 104 with the hoist chain 205. That said, in some alternate embodiments, multiple vertical jack devices and/or multiple horizontal jack devices can be employed and, in some such embodiments, the adjustments made by such jack devices (particularly assuming coordinated actuation of all vertical jack devices and/or coordinated actuation of all horizontal jack devices) can be strictly vertical and/or strictly horizontal.

Regardless, even assuming only that the vertical jack device 1360 and horizontal jack device 1364 are employed, by careful control of the adjustments made, any arbitrary amount of adjustment can be achieved (within the actuation ranges of the jack devices 1360, 1364). Further, although the above example adjustment process included the two steps involving vertical and then horizontal adjustment, such process need not be followed in every embodiment or circumstance. For example, in some circumstances, only one or the other of vertical and horizontal adjustments need be made. Also, in some embodiments it is appropriate to perform horizontal adjustment prior to vertical adjustment. Further, in some embodiments, proper alignment can only be achieved after multiple iterations of vertical and/or horizontal adjustments. It should again be appreciated that the same types of adjustments can be made with respect to both sides of the tainter gate 104 by way of actuatable jack devices located at each one of the support assemblies positioned at opposite sides of the tainter gate. Although actuatable jack devices are discussed above, it should further be appreciated that other actuation mechanisms can also be employed in other embodiments.

The gate support structure (e.g., the tainter gate support assembly 232) disclosed herein provides a stable and secure "dry" solution for repairing, rehabilitating, and/or replacing gate assembly (e.g., tainter gate assembly) components by using, for example, lock and dam concrete or similar pier structures for support. The gate support structure supports the lower trunnion arm of a tainter gate assembly in place while still providing adjustability so that the trunnion arm and trunnion pin bushing hole can be aligned (e.g., axially aligned) with the trunnion box anchorage plate bores. Advantageously, the support structure is generally not affected by surging and/or changing water elevations and differing water levels (e.g., "tail" water levels) do not affect the stability (e.g., there is no surging) of the disconnected tainter gate during repair and/or inspections because the gate support structure remains out of the water.

Moreover, in at least some embodiments, the gate support structure is at least substantially geometrically symmetric. Advantageously, a symmetric structure can be used on either descending side (e.g., the right or left descending side) of a tainter gate assembly and/or pier structure to which it is attached. Further, substantial cost savings can be achieved in that this structure can be used (e.g., installed) above the surface of the water passing through and controlled by the tainter gate assembly. In at least some circumstances, use of the support structure can eliminate, or at least partly reduce the need for, special underwater equipment/structures (e.g., for diving or supporting the tainter gate) and/or water-based (e.g., barges) equipment. And the support structure can readily be inspected on a frequent basis.

In at least some embodiments, the gate support structure will be used to replace tainter gate trunnion pins and bushings, conduct repairs to the trunnion boxes, allow inspection of the inside of the trunnion boxes, and/or allow any other work to be conducted that requires a tainter gate to be disconnected from its anchorage. The gate support structure stably secures a tainter gate assembly by the lower trunnion arm, while also providing adjustability of the lower trunnion arm in multiple directions (e.g., horizontally, vertically).

Embodiments of the gate support structure 232 disclosed herein can accommodate (or be easily modified to accommodate with minimum adjustment) downstream tainter gate piers and assemblies, including those in (and similar to those in) the United State Army Corps of Engineers (USACE) Lock and Dam system. Stated another way, advantageously, the gate support structure 232 can be used (with some modification) on gates or gate assemblies of various sizes and geometry.

The gate support structure (e.g., the tainter gate support assembly 232) supports a combination of loads/weights, including: a) a portion of the tainter gate assembly itself; b) mud and other debris that may be contained inside the gate assembly; c) loads resulting from resisting lateral movements of the tainter gate assembly due to the fleet angle (e.g., degrees of variation from plumb) of the tainter gate hoisting chains; d) wind loads; and e) lateral forces imposed by jacking or otherwise moving (e.g., horizontally and vertically) the gate assembly to adjust the position or location of the lower trunnion arm (e.g., during replacement of trunnion components). The gate support structure (e.g., the tainter gate support assembly 232) can be modified (e.g., with respect to the pedestal mounting assemblies shown and described with respect to FIG. 13A) to support a trunnion arm that is anchored in regard to at least one other type of pier assembly, such as when the trunnion arm is anchored to one side of a roller gate pier. Advantageously, the gate support structure (e.g., the tainter gate support assembly 232) permits work and/or inspections to be conducted at or on a gate assembly (e.g., replacement of the trunnion pins, bushings, and other components, as well as repair and/or inspection of the trunnion box, anchorage plates, etc.).

It should be reiterated that the above-described embodiments are merely intended to serve as examples of the range of subject matter intended to be encompassed herein. For example, one or more steps or portions of any of the processes shown in relation to trunnion pin sleeve removal and core drill assembly (FIGS. 5A-5B) can be combined in relation to one or more steps or portions of any of the processes described in relation to supporting and/or shifting a tainter gate by way of the support structure 232. Also, these various process steps can be omitted or rearranged in performing such combination processes or modified processes. Also, in other embodiments, the gate support structures can support the upper trunnion arms instead of, or in addition to, the lower trunnion arms.

Therefore, it is specifically intended that the present invention not be limited to the embodiments and illustrations contained herein, but include modified forms of those embodiments including portions of the embodiments and combinations of elements of different embodiments as come within the scope of the following claims.

What is claimed is:

1. A method of removing a trunnion pin sleeve from one or more support structures associated with a tainter gate subsequent to a performing of a core drilling operation upon a trunnion pin, the trunnion pin sleeve being a remainder of the trunnion pin following the performing of the core drilling operation, the method comprising:

causing either a constriction of at least one part of the trunnion pin sleeve in an inward manner relative to a central axis of the trunnion pin sleeve, or an application of a torque with respect to the at least one part of the trunnion pin sleeve about the central axis; and following the causing, applying a force to the at least one part of the trunnion pin sleeve so that the at least one part of the trunnion pin sleeve is pulled out from the one or more support structures.

2. The method of claim 1, wherein the method at least comprises the causing of the constriction.

3. The method of claim 2, wherein the causing of the constriction further includes removing a section of the trunnion pin sleeve proximate a first end of the trunnion pin sleeve, attaching a first end surface of a cross bar to a first region of an interior surface within the trunnion pin sleeve along or proximate to the first end of the trunnion pin sleeve, and attaching a second end surface of the cross bar to a second region of the interior surface.

4. The method of claim 3, wherein the second region of the interior surface is substantially diametrically opposed to the first region.

5. The method of claim 3, wherein the attaching of the second end surface is accomplished by way of a welding operation, and wherein the constriction occurs due to the welding operation.

6. The method of claim 5, wherein the first end of the trunnion pin sleeve is proximate a location where a first of the support structures is positioned in relation to the trunnion pin sleeve, the first support structure being a trunnion bushing, and wherein the section extends inward from the first end toward a second end of the trunnion pin sleeve, up to or proximate a side of a second of the support structures that is fixedly positioned in relation to a pier.

7. The method of claim 3, wherein the causing of the constriction includes rotating a turnbuckle associated with the cross bar.

8. The method of claim 3, wherein the method further includes the application of the torque, by application of an additional force to the cross bar.

9. The method of claim 2, wherein the causing of the constriction includes cutting a groove along trunnion pin sleeve and then welding together side surfaces along the groove, the welding resulting in the constriction.

10. The method of claim 2, wherein the causing of the constriction includes affixing a first barrier at a first end of the trunnion pin sleeve, affixing a second barrier at a second end of the trunnion pin sleeve, and adding a coolant material into the trunnion pin sleeve, the adding of the coolant material causing the constriction.

11. The method of claim 10, further comprising adding a rod attached to one or both of the barriers, and one or both of causing the application of the torque by way of the rod and applying the force to the rod.

12. The method of claim 1, wherein the causing of the application of the torque further includes attaching two or more lever arm supports to an interior surface of the trunnion pin sleeve, providing a lever arm in relation to the lever arm supports, and applying a torquing force to the lever arm.

13. The method of claim 12, wherein additionally the causing of the constriction is performed.

14. The method of claim 1, further comprising one or both of (i) cutting the trunnion pin sleeve into two or more sections and (ii) core drilling a trunnion bushing associated with one of the support structures.

15. The method of claim 1, further comprising a setting up of a core drill assembly in relation to the tainter gate, the setting up including:

i) arranging two core drill support mounts respectively on two sides of a trunnion arm assembly of the tainter gate;

ii) tightening the two core drill support mounts with respect to one another so that a combination of the two core drill support mounts is arranged around, in contact with, and secured in relation to, the trunnion arm assembly; and iii) attaching a core drill support platform to at least one of the core drill support mounts and a core drill to the core drill support platform.

16. The method of claim 15, further comprising one or both of:

(iv) attaching a laser to the core drill and employing the laser to achieve laser-based alignment; and (v) attaching a water plug at an orifice at a far end of the trunnion pin.

17. The method of claim 15, wherein (i) additionally includes providing at least two braces at a far end of the support platform away from the support mounts.

18. A method of removing a trunnion pin sleeve from one or more support structures associated with a tainter gate subsequent to a performing of a core drilling operation upon a trunnion pin, the trunnion pin sleeve being a remainder of the trunnion pin following the performing of the core drilling operation, the method comprising:

(a) either (i) causing a constriction of the trunnion pin sleeve in an inward manner toward a central region of the trunnion pin sleeve by way of one or both of a welding operation and an introduction of a cooling material within the trunnion pin sleeve, or (ii) core drilling a trunnion bushing within which the trunnion pin sleeve extends; and (b) applying a force generally along a central axis of at least a remainder portion of the trunnion pin sleeve so that the remainder portion is pulled out from the one or more support structures.

19. The method of claim 18, further comprising applying a further force in relation to the at least one part of the trunnion pin sleeve so as to apply a torque thereto, whereby the trunnion pin sleeve is thereby loosened in relation to the one or more support structures.

20. The method of claim 18, wherein (a) is preceded by an assembling of a core drill assembly to a trunnion arm.

21. The method of claim 20, further comprising wherein the core drill assembly includes a core drill that is employed to perform the core drilling of the trunnion bushing.

22. The method of claim 18, further comprising cutting the at least one part of the trunnion pin sleeve into multiple sections.

* * * * *